US007581954B2

(12) United States Patent
Schavone

(10) Patent No.: US 7,581,954 B2
(45) Date of Patent: Sep. 1, 2009

(54) FIREARMS TRAINING SIMULATOR SIMULATING THE RECOIL OF A CONVENTIONAL FIREARM

(75) Inventor: Mark Schavone, Pittsburgh, PA (US)

(73) Assignee: Newmatics Licensing LLC, Bethel Park, PA (US)

( * ) Notice: Subject to any disclaimer, the term of this patent is extended or adjusted under 35 U.S.C. 154(b) by 395 days.

(21) Appl. No.: 10/994,840

(22) Filed: Nov. 22, 2004

(65) Prior Publication Data

US 2005/0260545 A1 Nov. 24, 2005

Related U.S. Application Data

(63) Continuation-in-part of application No. 09/756,891, filed on Jan. 9, 2001, now Pat. No. 6,820,608.

(51) Int. Cl.
*F41A 33/06* (2006.01)
*F41G 3/26* (2006.01)
*F41G 1/00* (2006.01)

(52) U.S. Cl. ..... 434/18; 434/21; 42/117; 124/74

(58) Field of Classification Search ..... 124/73–77; 434/16–19; 42/117
See application file for complete search history.

(56) References Cited

U.S. PATENT DOCUMENTS

| | | | | |
|---|---|---|---|---|
| 2,023,497 | A | | 12/1935 | Trammell |
| 2,151,521 | A | | 3/1939 | Manville |
| 2,353,516 | A | | 7/1944 | Sochaczews |
| 2,708,319 | A | | 5/1955 | Ratsch |
| 2,980,096 | A | | 4/1961 | Merz |
| 3,049,977 | A | | 8/1962 | Reich |
| 3,741,189 | A | | 6/1973 | Kester et al. |
| 3,782,359 | A | | 1/1974 | Kester et al. |
| 4,004,566 | A | | 1/1977 | Fischer |
| 4,019,423 | A | | 4/1977 | Johnson |
| 4,083,349 | A | | 4/1978 | Clifford |
| 4,116,193 | A | | 9/1978 | Chiba |
| 4,380,437 | A | | 4/1983 | Yarborough, Jr. |
| 4,422,433 | A | | 12/1983 | Milliman |
| 4,725,235 | A | | 2/1988 | Schroeder et al. |
| 4,777,754 | A | * | 10/1988 | Reynolds, Jr. ..... 42/117 |
| 4,819,609 | A | * | 4/1989 | Tippmann ..... 124/72 |
| 4,829,877 | A | | 5/1989 | Zerega |
| 4,830,617 | A | | 5/1989 | Hancox et al. |
| 4,986,251 | A | | 1/1991 | Lilley |

(Continued)

FOREIGN PATENT DOCUMENTS

DE 3631262 A1 3/1988

(Continued)

*Primary Examiner*—Troy Chambers
(74) *Attorney, Agent, or Firm*—William F. Lang, IV; Lang Patent Law LLC

(57) ABSTRACT

A firearms training simulator provides recoil simulating the recoil of a conventional firearm. The valve assembly provides consistent rearward gas pressure for generating recoil. Preferred embodiments of the firearms training simulator may include a means for adjusting the amount of recoil provided. A trigger mechanism permitting semi-automatic operation, or full automatic operation at a user selectable cyclic rate, is provided. The firearms training simulator further provides a laser emitter structured to emit a laser substantially along the same path as a bullet fired from a conventional firearm having the same configuration as the simulator.

23 Claims, 22 Drawing Sheets

U.S. PATENT DOCUMENTS

| | | | | | |
|---|---|---|---|---|---|
| 5,063,905 | A | | 11/1991 | Farrell | |
| 5,150,701 | A | | 9/1992 | Wackrow et al. | |
| 5,244,431 | A | | 9/1993 | D'Andrade | |
| 5,341,790 | A | | 8/1994 | Ebert | |
| 5,343,650 | A | * | 9/1994 | Swan | 42/117 |
| 5,400,536 | A | | 3/1995 | Milliman | |
| 5,462,042 | A | | 10/1995 | Greenwell | |
| 5,497,758 | A | | 3/1996 | Dobbins et al. | |
| 5,509,399 | A | * | 4/1996 | Poor | 124/76 |
| 5,515,838 | A | | 5/1996 | Anderson | |
| 5,586,545 | A | | 12/1996 | McCaslin | |
| 5,592,931 | A | | 1/1997 | Johnson et al. | |
| 5,613,483 | A | | 3/1997 | Lukas et al. | |
| 5,655,510 | A | * | 8/1997 | Kunimoto | 124/81 |
| 5,660,159 | A | | 8/1997 | Clayton | |
| 5,680,853 | A | | 10/1997 | Clayton | |
| 5,709,199 | A | | 1/1998 | Johnson et al. | |
| 5,711,286 | A | | 1/1998 | Petrosyan et al. | |
| 5,760,328 | A | | 6/1998 | Robbins | |
| 5,771,875 | A | | 6/1998 | Sullivan | |
| 5,857,854 | A | | 1/1999 | Kwalwasser | |
| 5,913,303 | A | | 6/1999 | Kotsiopoulos | |
| 5,947,738 | A | * | 9/1999 | Muehle et al. | 434/16 |
| 6,026,797 | A | * | 2/2000 | Maeda et al. | 124/74 |
| 6,202,533 | B1 | | 3/2001 | Reynolds et al. | |
| 6,412,390 | B1 | | 7/2002 | Dindl | |
| 6,470,871 | B2 | | 10/2002 | Casas-Salva | |
| 6,490,822 | B1 | * | 12/2002 | Swan | 42/71.01 |
| 6,497,229 | B1 | * | 12/2002 | Maeda | 124/76 |
| 6,572,375 | B2 | * | 6/2003 | Shechter et al. | 434/19 |
| 2003/0056778 | A1 | * | 3/2003 | Schavone | 124/74 |
| 2005/0091900 | A1 | * | 5/2005 | Tippmann, Jr. | 42/76.01 |

FOREIGN PATENT DOCUMENTS

| | | | |
|---|---|---|---|
| FR | 2 345 694 | | 10/1977 |
| GB | 2319076 | A | 5/1988 |
| GB | 2 255 399 | | 11/1992 |

* cited by examiner

FIREARMS TRAINING SIMULATOR SIMULATING THE RECOIL OF A CONVENTIONAL FIREARM

CROSS-REFERENCED TO RELATED APPLICATION

This application is a continuation-in-part of U.S. patent application Ser. No. 09/756,891, filed Jan. 9, 2001 now U.S. Pat. No. 6,820,608 entitled "Compressed Gas Powered Gun Simulating the Recoil of a Conventional Firearm."

BACKGROUND OF THE INVENTION

1. Field of the Invention

This application relates to firearm training simulators. More specifically, the invention provides a firearms training simulator duplicating the recoil of a conventional firearm, and providing indicia of the path of a bullet if such a bullet had been fired from a conventional firearm.

2. Description of the Related Art

Firearms training for military personnel, law enforcement officers, and private citizens increasingly encompasses role playing and decision making in addition to marksmanship. Such training often includes competing against role players and/or responding to situations projected onto a screen in front of the trainee. Although self-healing screens exist, permitting the use of conventional firearms for such training, the use of such a system requires a location appropriate to the use of conventional firearms. Furthermore, such systems are expensive and can be unreliable.

To increase the number of locations where such training may be safely conducted, and to provide a safe means of force on force role playing, alternatives to conventional firearms have been developed. These alternatives include paintball, Simunitions, and the use of a laser to show the path a bullet would have taken had one been fired. Such alternatives, however, do not duplicate all of the characteristics of a conventional firearm, thereby limiting the extent to which the training will carry over to the use of conventional firearms. The characteristics of a firearm that should be duplicated include size, weight, grip configuration, trigger reach, trigger pull weight, type of sights, level of accuracy, method of reloading, method of operation, location and operation of controls, and recoil.

Of all of these characteristics, recoil is the most difficult to duplicate. The inability to get a trainee accustomed to the recoil generated by a conventional firearm is one of the greatest disadvantages in the use of various firearm training simulators. Recoil not only forces the shooter to require the sights after shooting, but also forces the shooter to adapt to a level of discomfort that is proportional to the energy of the cartridge for which the firearm is chambered. Recoil is significantly more difficult to control during full automatic fire than during semi-automatic fire, making the accurate simulation of both recoil and cyclic rate critical in ensuring that simulator training carries over to the use of actual firearms.

An example of a presently available firearms training simulator is disclosed in U.S. Pat. No. 5,857,854, issued to Y. Kwalwasser on Jan. 12, 1999, disclosing a recoil simulator for a weapon. The recoil simulator includes a barrel having a plug therein, with an air inlet opening disposed just behind the plug. A piston is reciprocally mounted within a cylinder inside the barrel, with either the piston or the cylinder being stationery, and the other component being attached to a bolt. Upon detection of the firing hammer operation by a sensor, compressed air is directed into the air inlet opening, thereby driving back the bolt against the spring to produce a felt recoil. In an alternative embodiment, the piston and reciprocating bolt may be located within a gas tube above the barrel. A laser generator may be provided at the muzzle end of the barrel. The level of recoil generated is adjusted by modifying the length of travel of the piston and bolt, or the cylinder and bolt, depending upon the embodiment used.

U.K. Patent Application Number 2 319 076 A, published on May 13, 1998, discloses a device for cycling a training gun. The device includes a cylinder that is inserted into the barrel of the gun. A piston is reciprocally mounted within the cylinder and is spring biased towards a forward position. Upon the firing of a gas cartridge, the application recites that compressed gas will flow through a bore within the piston into a chamber forward of the piston, thereby driving the piston rearward with sufficient force to cycle a semi-automatic firearm. However, the compressed gun would also apply forward pressure on the piston, making it unlikely that this device would work as described.

U.S. Pat. No. 2,023,497, issued to W. Trammel on Dec. 10, 1935, discloses a shooting training device having a spring biased plunger, which, upon pulling the trigger, impacts a movable butt plate within the shoulder stock to simulate recoil. A beam of light is projected from the barrel to show the path that would be followed by a bullet fired from the barrel. A mechanically driven projector may be used in conjunction with the training gun to project a spot of light on a screen to be used to the target, and optionally a second spot of light to show the correct lead distance. The use of a movable butt plate is unrealistic in that the shooter's hands cannot be used to control recoil.

U.S. Pat. No. 4,829,877, issued to J. E. Zerega on May 16, 1989, discloses an accessory for converting a small bore firearm into a theatrical stage prop. The device includes a barrel having a rearwardly spring biased mass therein, and a plurality of passages parallel to and surrounding the barrel. Upon the firing of a blank cartridge, the expanding gases push the spring biased mass forward, until the mass has reached a position where it no longer blocks the entrance to the passages surrounding the barrel. The expanding gases then travel though these passages, back into the barrel beyond the spring for the mass, and out the muzzle. The spring drives the mass rearward, thereby simulating recoil. This would result in a recoil that is delayed as compared to the recoil of an actual firearm, because the mass must first move forward against spring pressure before moving rearward.

U.S. Pat. No. 2,708,319, issued to W. A. Tratsch, on May 17, 1955, discloses an air rifle recoil simulator. The recoil simulator includes a spring biased piston within the shoulder stock, and an air passage extending from a valve to a location in front of the piston. Upon pulling the trigger, compressed air pushes the piston rearward against the spring, thereby simulating recoil. The use of a movable butt plate is unrealistic in that the shooter's hands cannot be used to control recoil.

U.S. Pat. No. 4,380,437, issued to G. W. Yarborough, Jr., on Apr. 19, 1983, discloses a small weapon simulator. The simulator includes a laser beam for simulating the path of a bullet. A muzzle-rise module releases a downwardly directed jet of air from the forward portion of the gun to simulate muzzle-rise. Recoil is simulated through an air pressure driven piston pushing against the butt plate. A sound module having an audio speaker simulates the noise of a rifle firing a bullet. The use of a movable butt plate is unrealistic in that the shooter's hands cannot be used to control recoil.

U.S. Pat. No. 5,244,431, issued to B. M. D'Andrade on Sep. 14, 1993, discloses a recoiling toy pistol. Upon the pulling of the trigger, a weight is pushed against a spring in one direction, and then is released to travel rearward under spring pressure, thereby simulating recoil. A weight moved by a single finger can hardly produce a realistic level of recoil.

U.S. Pat. No. 4,725,235, issued to J. E. Schoeder et al. on Feb. 16, 1988, discloses a marksmanship training apparatus. The apparatus includes a shoulder stock insert having a solenoid impacting a kick plate in response to trigger activation. The use of a movable butt plate is unrealistic in that the shooter's hands cannot be used to control recoil.

Accordingly, there is a need for a firearms training simulator duplicating the recoil of a conventional firearm. Additionally, there is a need for a firearms training simulator duplicating the full automatic cyclic rate of a conventional full automatic firearm. There is a further need to combine these characteristics into a firearms training simulator that may be used safely within a wide variety of locations, making training facilities easier and more economical to construct, lowering the cost of ammunition and training, reducing noise levels, and facilitating legal ownership.

SUMMARY OF THE INVENTION

The present invention provides a firearms training simulator providing a recoil similar to that of a gun firing a powder propelled projectile. The simulator may include a means for projecting a laser beam along the path of a bullet that would have been discharged from an actual firearm. The simulator also duplicates many other features of a conventional firearm, for example, the sights, the positioning of the controls, and method of operation. One preferred embodiment simulates the characteristics of an AR-15 or M-16 rifle, although the invention can easily be applied to simulate the characteristics of other conventional firearms.

The operation of a firearms training simulator of the present invention is controlled by a combination of the trigger assembly, bolt, buffer assembly, and valve. Preferred embodiments may be capable of semi-automatic fire and full automatic fire. Preferably, the cyclic rate of full automatic fire approximately duplicates the cyclic rate of a conventional automatic rifle. Alternatively two different full automatic cyclic rates may be provided.

The trigger assembly includes a trigger having a finger-engaging portion and a selector-engaging portion, a selector switch, a trigger bar, a sear trip, and a sear. The selector switch will preferably be cylindrical, having three bearing surfaces corresponding to safe, semi-automatic fire, and full automatic fire at a low cyclic rate, and a channel corresponding to full automatic fire at a high cyclic rate. These surfaces and channel of the selector bear against the selector engaging portion of the trigger, permitting little or no trigger movement if safe is selected, and increasing trigger movement for semi-automatic fire, low cyclic rate full automatic fire, and high cyclic rate full automatic fire, respectively. The sear is mounted on a sliding pivot, and is spring-biased towards a rearward position. The sear has a forward end for engaging the sear trip, and a rear end for engaging the bolt. The bolt preferably contains a floating mass, and reciprocates between a forward position and a rearward position. Although the bolt is spring-biased towards its forward position, the bolt will typically be held in its rearward position by the sear except during firing.

The valve assembly includes a reciprocating housing containing a stationary forward valve poppet, a sliding rear valve poppet, and a spring between the front and rear valve poppets. The spring pushes the rear valve poppet rearward, causing the rear poppet to bear against the housing, thereby closing the rear valve and pushing the housing rearward. Pushing the housing rearward causes the housing to bear against the front valve poppet, thereby closing the front valve.

Before the trigger is pulled, the trigger is in its forwardmost position, the bolt is held to the rear by its engagement with the sear, and the sear, although spring-biased rearward, is pushed towards its forwardmost position by the bolt. Pulling the trigger causes the trigger bar to move rearward, pivoting the sear trip upward. The upward movement of the sear trip pushes upward on the forward end of the sear, causing the rearward end of the sear to move down. The bolt is then free to travel forward, where the bolt strikes the rear valve, thereby moving the rear valve relative to the housing and opening the rear valve. Air pressure between the O-ring on the bolt face and the O-ring on the rear of the valve housing causes the housing to move forward, thereby opening the forward valve. Opening the rear valve supplies air pressure to the bolt face, thereby causing the bolt to return to its rearward position. If semi-automatic fire is selected, the limited movement of the sear trip, combined with the rearward spring-bias on the sear, causes the sear to move backwards on its pivot to a position where the sear trip can no longer apply upward pressure to the forward portion of the sear. The rear portion of the sear therefore pivots upward. The bolt will be propelled rearward to a point slightly behind the position wherein it engages the sear. As the bolt returns forward, the sear, which is no longer held in place by the sear trip, will engage the bolt, preventing further forward movement. From this position of the components, the trigger must be released before it can be pulled to fire another shot.

If full automatic fire at a slow cyclic rate is selected, the trigger may be pulled slightly farther to the rear before it engages the selector, thereby causing the sear trip to pivot slightly higher. Whereas the upper bearing surface of the sear trip pushes the sear up to initially release the bolt, here, the lower end bearing surface of the sear trip pushes the sear up sufficiently so that, when the bolt catches the sear, there is only about $1/32^{nd}$ inch of engagement between the sear and bolt. The floating mass bolt is thereby momentarily held in its rearward position by the sear, which cams forward off the sear trip as the forward motion of the bolt pushes the sear from its rearward position to its forward position.

If full automatic fire at a high cyclic rate is selected, the trigger is allowed to travel to its maximum rearward position. The sear trip is thereby pivoted upward to its maximum extent, causing the lower end bearing surface of the sear trip to push the sear completely out of the way of the bolt. Therefore, as soon as the spring behind the bolt driver overcomes the rearward momentum of the bolt, the bolt will simply return forward and again actuate the valve.

A compressed gas powered gun of the present invention uses a recoil buffer system for biasing the bolt forward, and for providing a recoil for the shooter in conjunction with the floating mass bolt. A preferred buffer system includes a floating mass bolt driver, and an air resistance bolt driver, with a spring disposed there between. This assembly is located in a tube within the air gun's shoulder stock, which is preferably a cylindrical tube. The buffer assembly may be oriented so that either the air resistance bolt driver or the floating mass bolt driver is positioned directly behind the bolt, with the other bolt driver placed at the rear of the stock. The forward bolt driver will thereby abut the rear of the bolt, pushing the bolt forward.

If the air resistance bolt driver is positioned directly behind the bolt, light recoil results. The air resistance bolt driver has less mass than the floating mass bolt driver, resulting in less mass reciprocating back and forth. Additionally, the air resistance bolt driver will trap air behind it as it reciprocates, thereby slowing travel of the reciprocating mass. Conversely, positioning the floating mass bolt driver behind the bolt results in heavier recoil, due to the increased reciprocating mass and the lack of the ability of the floating mass bolt driver to trap air. The shooter may therefore select the desired level of recoil to correspond with the recoil of the conventional firearm the shooter wishes to simulate.

Some preferred embodiments of the invention will include a laser emitter structured to emit a laser substantially parallel to the path of a bullet that would have been discharged from an actual firearm upon the pulling of the trigger of the simulator. Suitable laser emitters are presently available, but have not yet been combined with firearms training simulators providing the advantages of the present invention. One preferred laser emitter assembly includes a laser emitter housed within a front sight block disposed forward of the forward hand guards, and underneath the front sight. The electronics, battery, and switch for the laser emitter may be located within the handguards, wherein they are easily reached for service. One embodiment of the switch may be a roller switch structured to be actuated by a switching rod extending forward from the bolt. When the bolt moves forward in response to pulling the trigger, the switching rod engages the roller of the switch, thereby depressing the switch and actuating the laser. Another embodiment uses a proximity switch mounted in a location wherein a magnet may be brought into contact with it upon forward movement of the bolt. A preferred location is adjacent to the juncture between a barrel and upper receiver. A magnet affixed to the bolt is structured to be brought into proximity with the proximity switch when the bolt is in its forwardmost position, thereby causing the proximity switch to actuate the laser.

It is therefore an object of the present invention to provide a firearms training simulator simulating the recoil of a conventional firearm.

It is another object of the present invention to provide a firearms training simulator wherein the level of recoil provided to the shooter may be selected by the shooter.

It is a further object of the present invention to provide a firearms training simulator capable of simulating the operation of a conventional firearm.

It is another object of the present invention to provide a firearms training simulator capable of both semi-automatic and full automatic operation.

It is a further object of the present invention to provide a firearms training simulator wherein different cyclic rate of full automatic fire may be utilized.

It is another object of the present invention to provide a firearms training simulator including a laser emitter assembly structured to emit a laser substantially along the path of a bullet that would have been discharged from an actual firearm.

These and other objects of the present invention will become more apparent through the following description and drawings.

BRIEF DESCRIPTION OF THE DRAWINGS

Like reference characters denote like elements throughout the drawings.

DETAILED DESCRIPTION OF THE PREFERRED EMBODIMENTS

Figure 1:
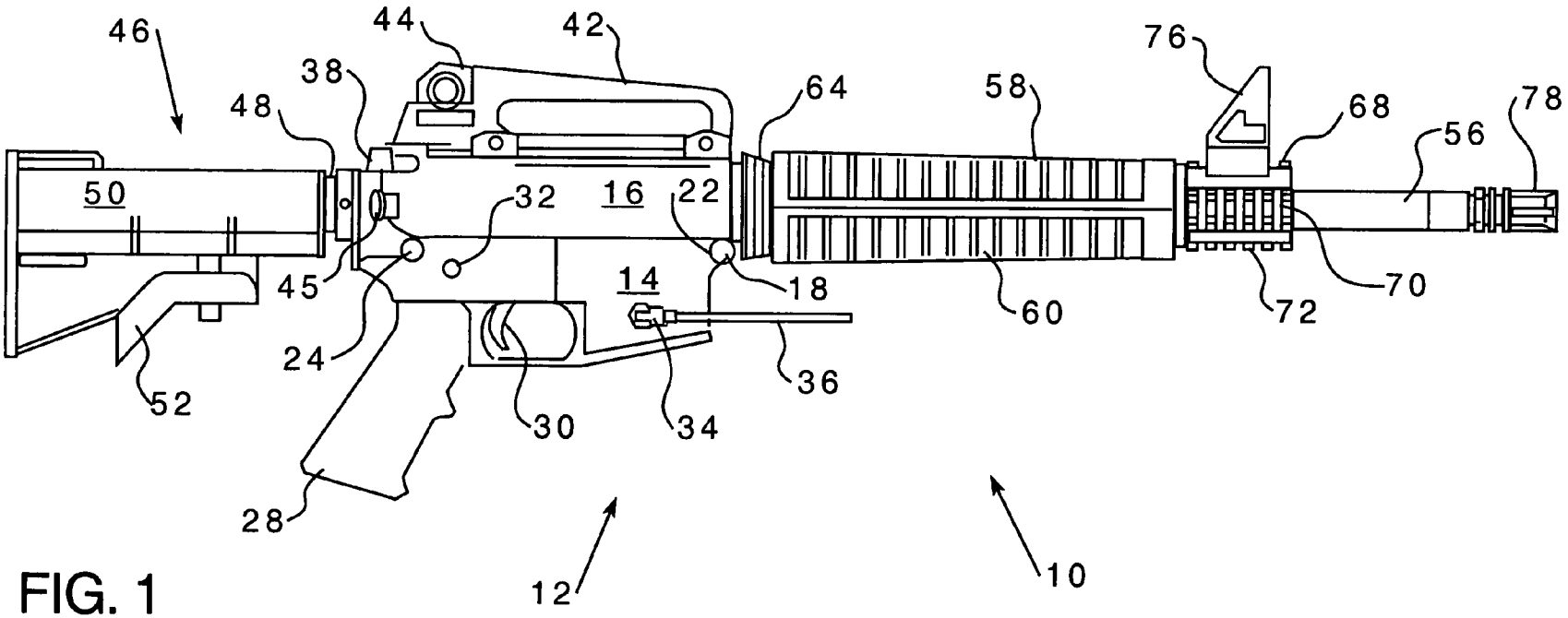
FIG. 1 is a side view of a firearms training simulator according to the present invention.
Figure 2:
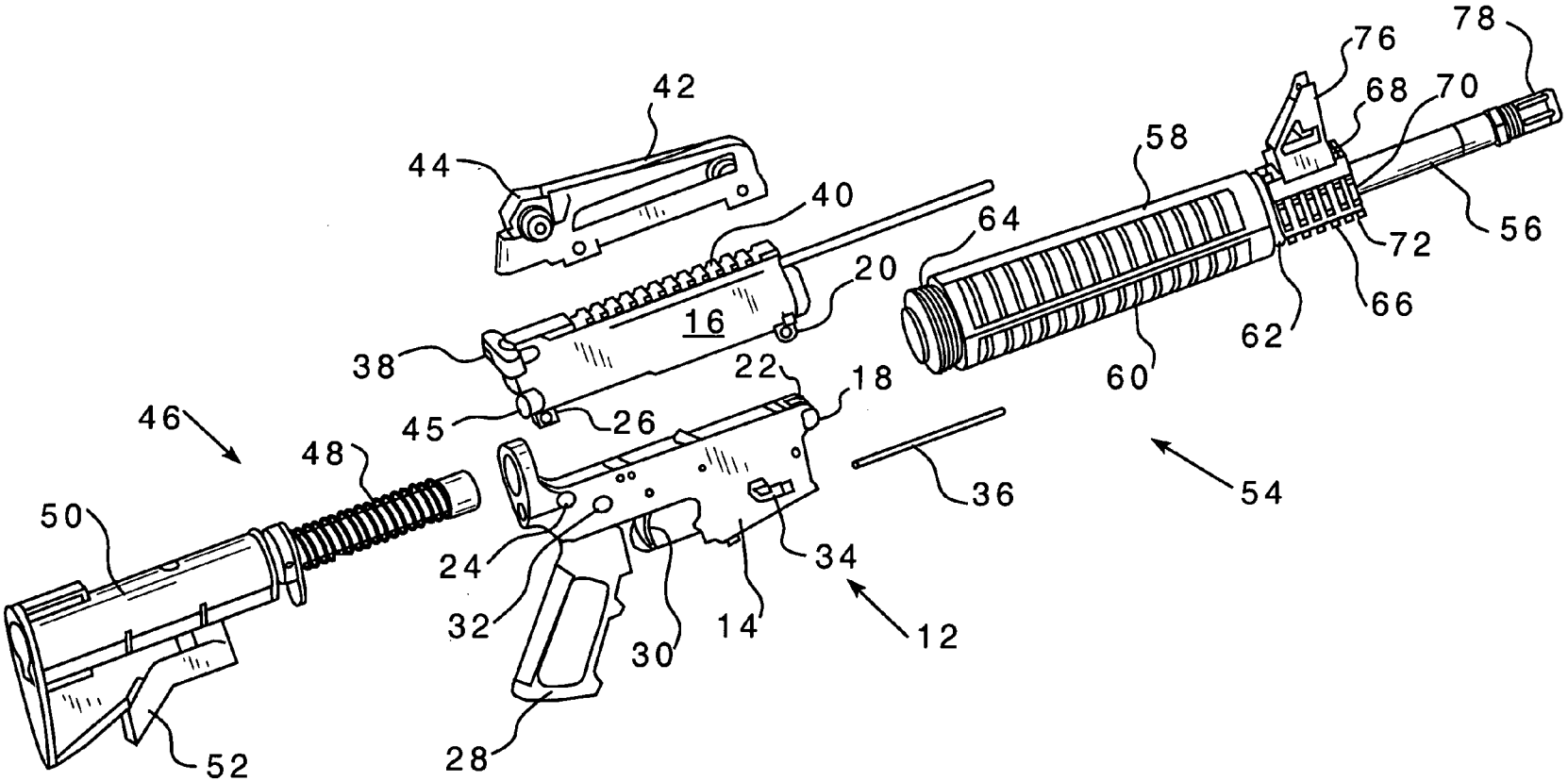
FIG. 2 is a partially exploded side isometric view of a firearms training simulator according to the present invention.

The present invention provides a firearms training simulator that simulates the recoil of a conventional firearm. Referring to FIGS. 1-2, an embodiment of the firearms training simulator representing an AR-15 or M-16 rifle is illustrated. The firearm straining simulator 10 includes a receiver 12 which in the present embodiment includes a lower receiver 14 mated to an upper receiver 16. Like a conventional M-16, the upper receiver 16 is pivotally secured to the lower receiver 14 by a screw or pin 18 passing through corresponding apertures 20, 22 within the upper receiver 16 and lower receiver 14, respectively. A captive takedown pin 24 is secured within the rear portion of the lower receiver 14, and is structured to fit within the aperture 26 defined within the rear portion of the upper receiver 16. The lower receiver 14 also includes a pistol grip 28, a trigger 30 disposed in front of the pistol grip 28, and a selector 32 disposed above the pistol grip 28. The lower receiver 14 further includes a compressed gas inlet fitting 34 structured to receive a compressed gas hose 36 leading to a compressed gas supply. Suitable compressed gas supplies are known to those skilled in the art of air guns, and therefore not described in detail herein.

The upper receiver 16 is structured to receive a reciprocating bolt therein, as will be described in detail below. The upper receiver 16 is further structured to receive a charging handle 38 directly above the bolt, and structured to retract the bolt upon itself being retracted. The top of the upper receiver 16 includes a means for securing a rear sight thereon, with a preferred means being a universal sight rail 40 such as a Weaver rail. The illustrated rear sight 42 is a conventional carrying handle sight having an adjustable aperture sight mechanism 44 mounted thereon. It will be apparent to those skilled in the art that other conventional rear sights, such as folding aperture rear sights, telescopic sights, and/or illuminated dot sights or combinations thereof may be mounted to the sight rail 40. A forward assist assembly 45 is defined within the upper receiver 16, thereby facilitating any desired training drills utilizing a forward assist. The forward assist 45 is identical to that of a conventional AR-15 or M-16 rifle, and is therefore not further described.

A shoulder stock 46 is secured to the lower receiver 14. The illustrated embodiment of a shoulder stock 46 is a collapsible, telescoping shoulder stock having a buffer tube 48 upon which a sliding shoulder piece 50 is slidably mounted, with the shoulder piece 50 being structured to be locked in place on the buffer tube by the adjustment lever 52.

Figure 16:
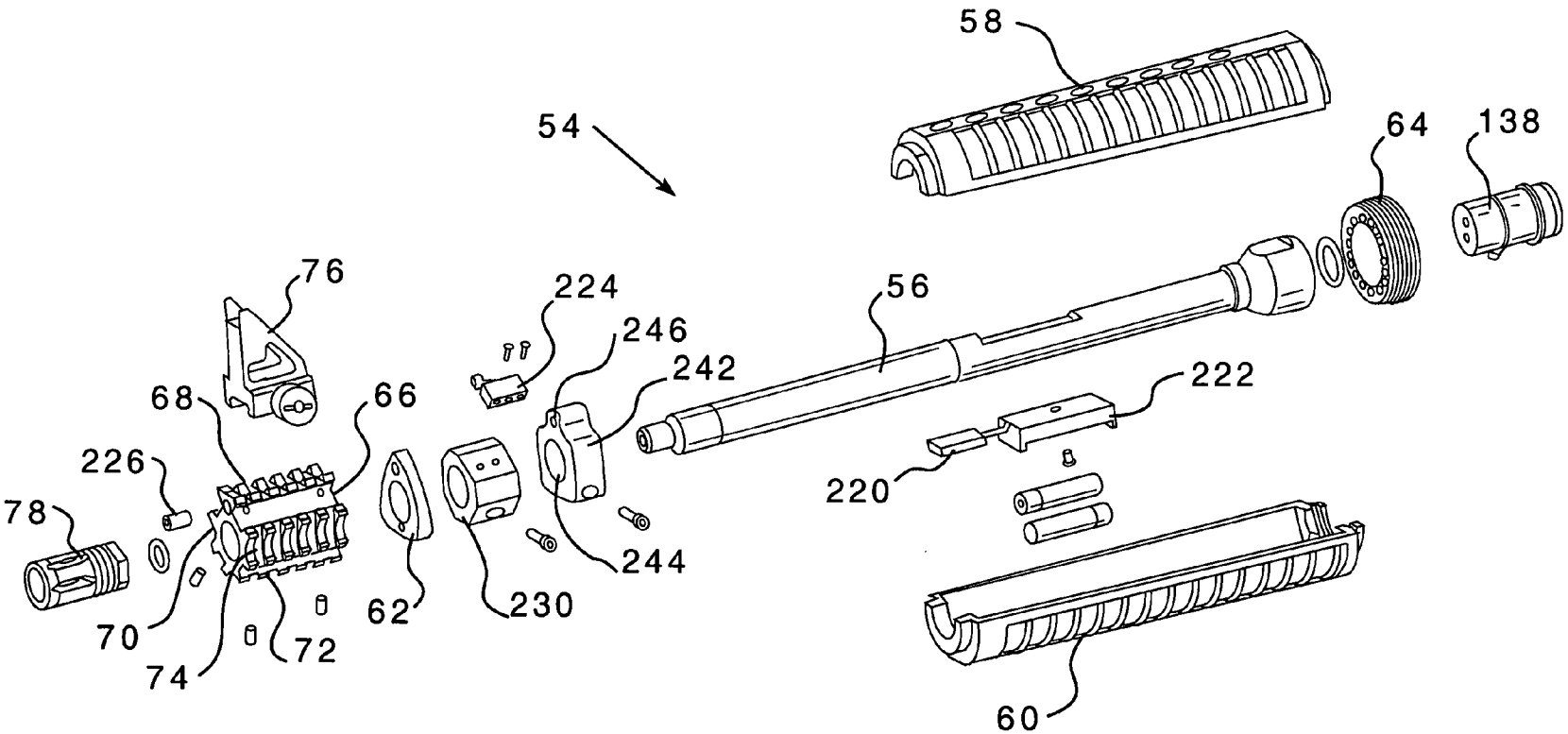
FIG. 16 is an exploded side isometric view of a valve assembly for a firearms training simulator according to the present invention.

A barrel assembly 54 is mounted to the front portion of the upper receiver 16. The barrel assembly 54 includes a barrel 56 which is directly secured to the upper receiver 16. An upper handguard 58 and lower handguard 60 are secured between the nosecap 62 at their forward end and a lock ring 64 that is slidably mounted on a barrel nut assembly, which is not shown and well known to those skilled in the art. A front sight block 66 is disposed around the barrel 56 in front of the nosecap 62. The illustrated front sight block 66 includes a top Weaver rail 68, right side Weaver rail 70, lower Weaver rail 72, and left side Weaver rail 74 (FIG. 16). In the illustrated embodiment, a front sight 76 is detachably mounted to the top Weaver rail 68, and includes a post type front sight therein (not shown and well known in the art). Alternative front sights include folding front sights, or the front sight 76 may be omitted entirely if an optical or illuminated dot sight is selected. The remaining Weaver rails 70, 72, 74 may, if desired, be used to attach items such as flashlights, laser sights, bipods and/or sling swivels to the firearms training simulator 10 to bring the configuration of the firearms training simulator 10 as close as possible to the actual rifle being used by the trainee. The illustrated embodiment of the firearms training simulator 10 also includes a flash hider 78 at the muzzle end of the barrel 56, thereby further conforming the configuration of the firearms training simulator 10 to that of an actual rifle.

Figure 3:
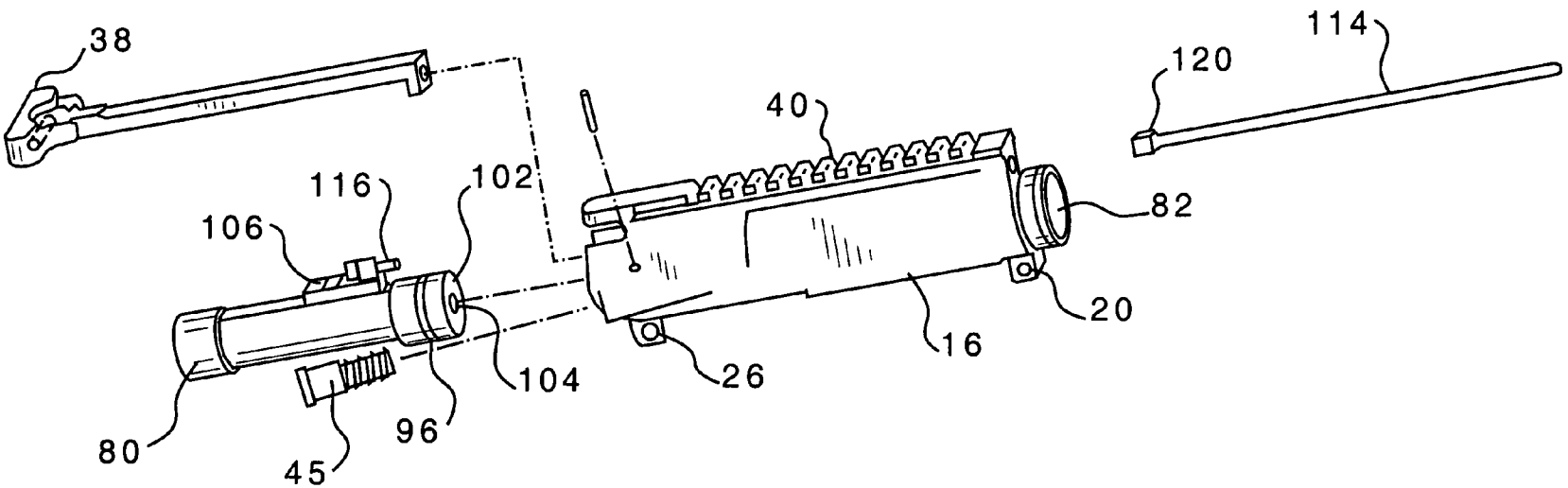
FIG. 3 is a partially exploded view of an upper receiver for a firearms training simulator according to the present invention.
Figure 4:
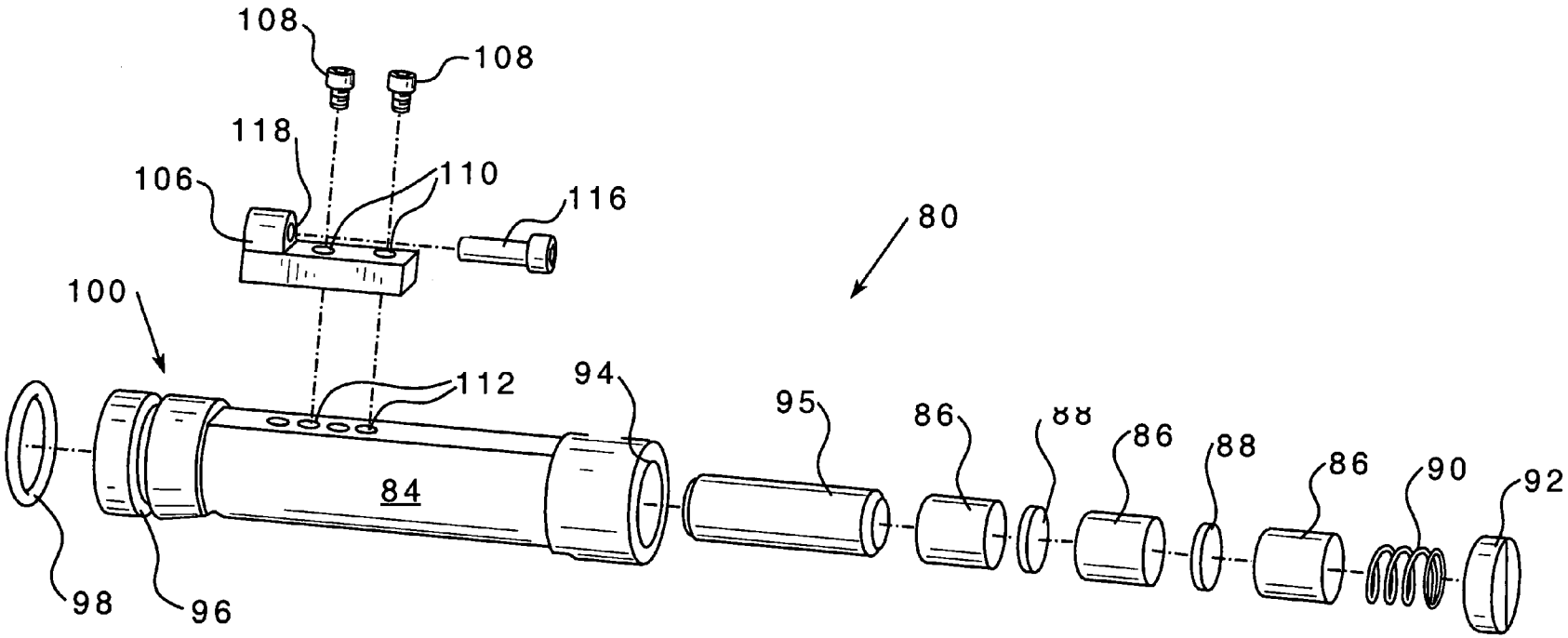
FIG. 4 is an exploded side isometric view of a bolt for a firearm training simulator according to the present invention.
Figure 11:
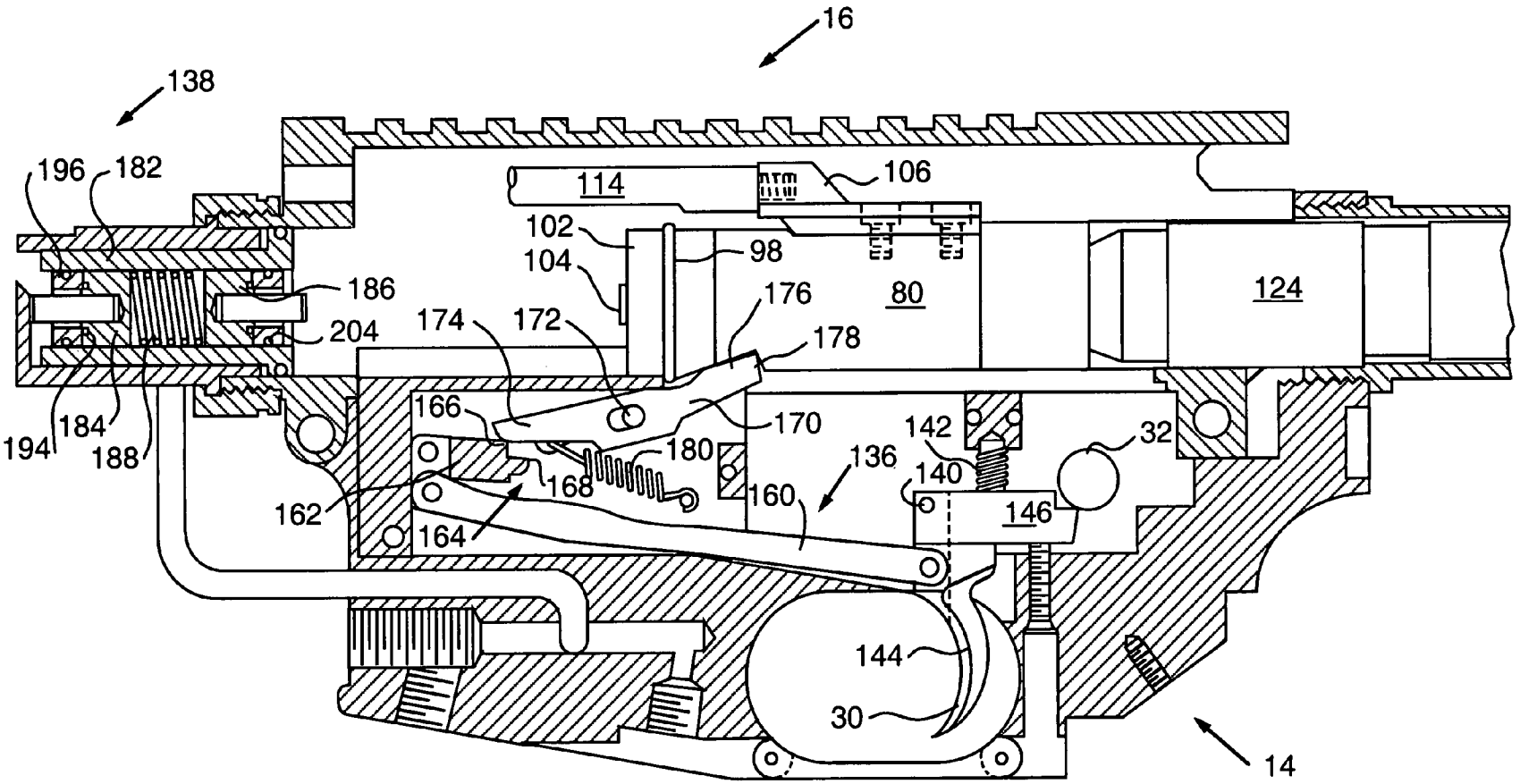
FIG. 11 is a side cross-sectional view of a trigger assembly, valve assembly, and bolt of a firearms training simulator according to the present invention, showing the position of the components before the trigger is pulled.

Referring to FIGS. 3 and 4, the bolt 80 is slidably mounted within the channel 82 defined within the upper receiver 16. The bolt 80 includes a tubular body 84 having a floating mass therein. A preferred floating mass includes a plurality of weights 86 separated by cushions 88. Although 3 weights 86 are illustrated, a different number may be selected. A spring 90 for biasing the weights 86 forward is disposed between the rearmost weight 86 and an end cap 92 structured to be secured to the back end 94 of the bolt 80. A slot 96 for receiving an O-ring 98 is defined in a forward portion 100 of the bolt 80. Referring briefly to FIG. 11, the bolt 80 includes a forward gas receiving surface 102 across its entire forward face, and defines a centrally located valve actuation projection 104 on the gas receiving surface 102. A bolt key 106 is secured to the top of the bolt 80, in the illustrated embodiments by a pair of screws 108 passing through the apertures 110 within the bolt key 106, and being secured within the apertures 112 defined within the body 84 of the bolt 80. A switch actuation rod 114 may be secured to the bolt key 106 so that it extends forward of and substantially parallel to the bolt 80, in the illustrated embodiment by the screw 116 passing through the aperture 118 defined within the bolt key 106, and into another aperture within the rear portion 120 of the switch actuation rod 114. A spacer 95 may be disposed in front of the forwardmost weight 86 to limit the travel of the weights 86 to that which is desired.

Figure 5:
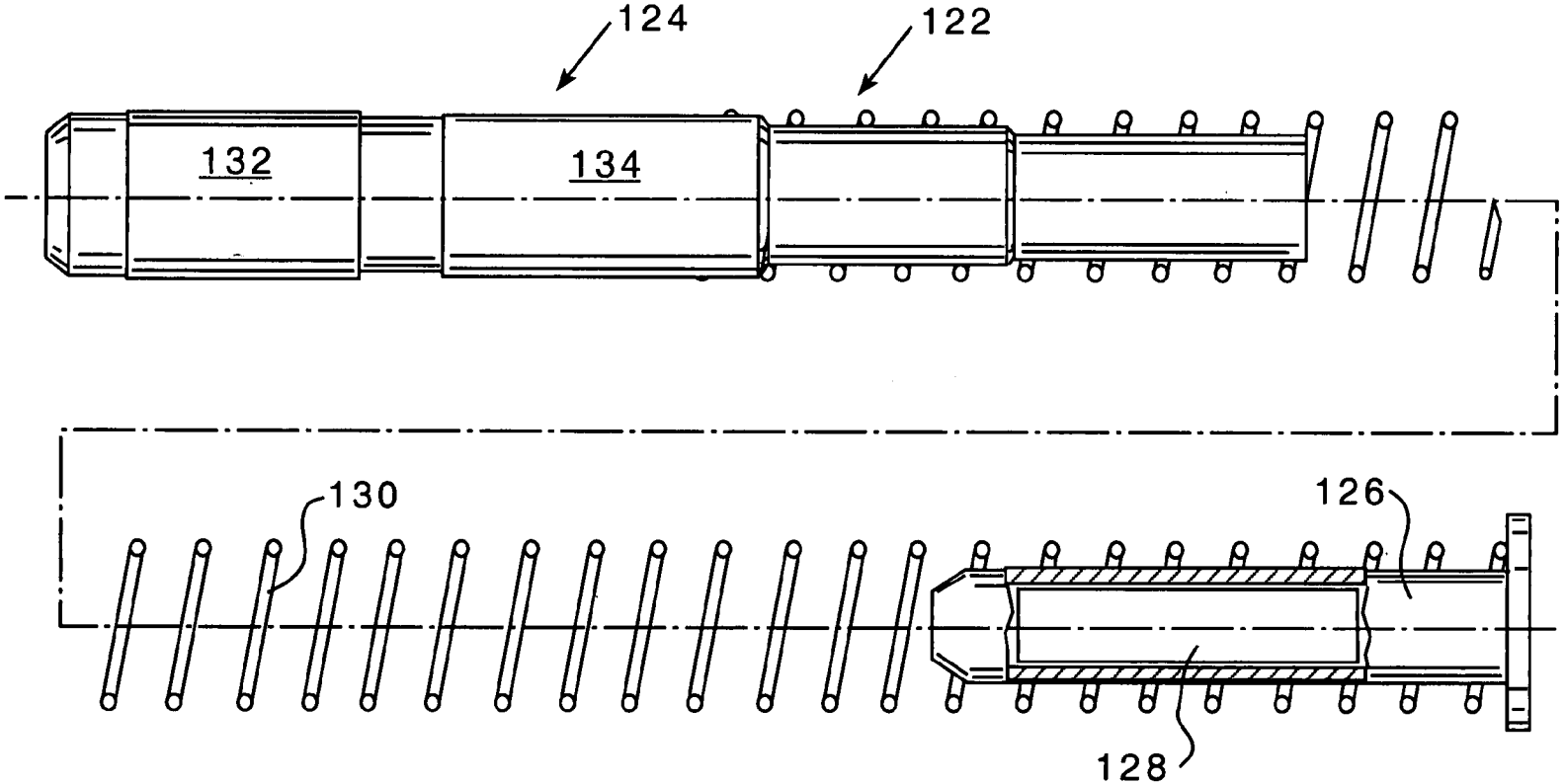
FIG. 5 is a side view of a buffer assembly for a firearms training simulator according to the present invention.
Figure 6:
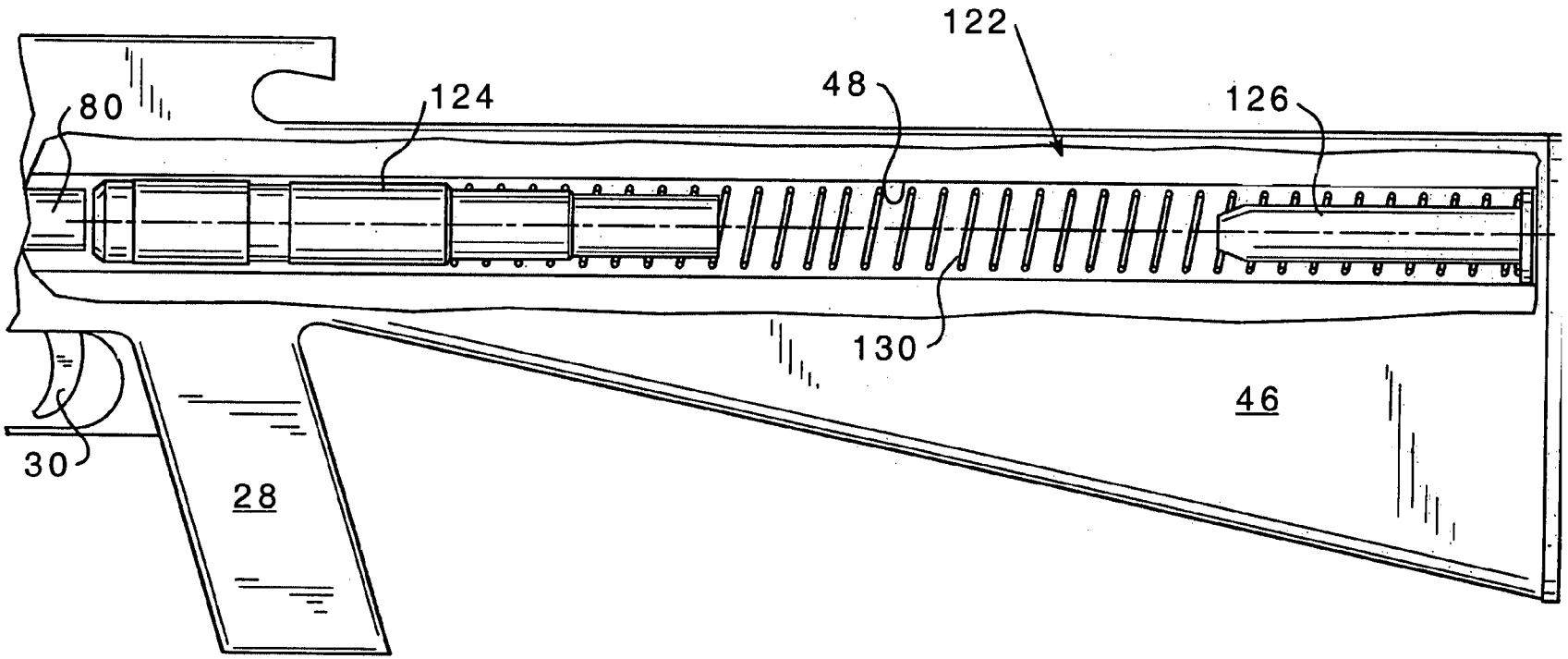
FIG. 6 is a side cutaway view of a buffer assembly for a firearms training simulator according to the present invention, showing the components configured for low recoil.
Figure 7:
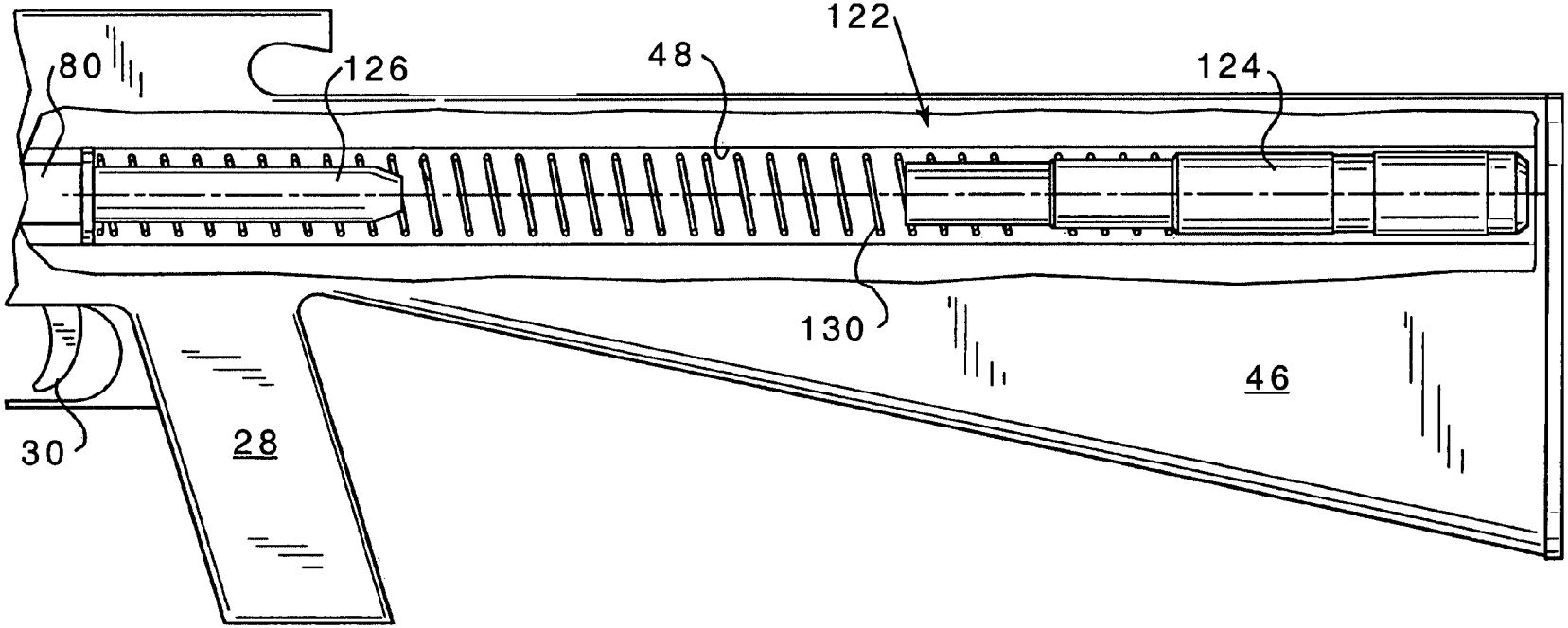
FIG. 7 is a side cutaway view of a buffer assembly for a firearms training simulator according to the present invention, showing the components configured for high recoil.

Referring to FIGS. 5-7, a buffer system 122 is illustrated. A preferred buffer system 122 includes an air piston bolt driver 124, a floating mass bolt driver 126 having a floating mass 128 therein, and a spring 130 disposed therebetween. The air piston bolt driver may be made of two pieces: a forward portion 132 and a rear portion 134. The buffer system 122 is located directly behind the bolt 80, and is housed within the buffer tube 48. Depending on the length of the buffer tube 48, the forward portion 132 of the air resistance bolt driver 124 may either be attached or removed from the rear portion 134 of the air piston bolt driver 124.

FIG. 6 illustrates the buffer assembly 122 configured for low recoil. The air piston bolt driver 124 is located directly behind the bolt 80, so that it will reciprocate along with the bolt 80. The air resistance bolt driver 124 has a low mass as compared to the floating mass bolt driver 126, and will also trap air behind it as it reciprocates, thereby reducing the level of recoil felt by a shooter by reducing the total reciprocating mass of the bolt 80 and bolt driver 124, and also through increased air resistance. If greater recoil is desired, the configuration of FIG. 7, wherein the floating mass bolt driver 126 is located behind the bolt 80, may be selected. The high mass of the floating mass bolt driver 126 as compared with the air piston bolt driver 124, combined with the inability of the floating mass bolt driver to trap air behind it, increases the level of recoil felt by a shooter by increasing the total mass of the bolt 80 and the bolt driver 126 that reciprocates back and forth. Additionally, the floating mass within both the bolt 80 and bolt driver 126 will continue to move rearward once the bolt 80 and floating mass bolt driver 126 have reached their maximum rearward position, further enhancing the sensation of recoil experienced by the shooter. Referring back to FIGS. 1 to 2, the configuration of the buffer system 122 may be easily changed by driving the pin 24 to the right, and then pivoting the upper receiver 16 with respect to the lower receiver 14 around the screw or pin 18. The spring 130 and bolt drivers 124, 126 may then be removed from the buffer tube 48 and repositioned as desired.

Figure 8:
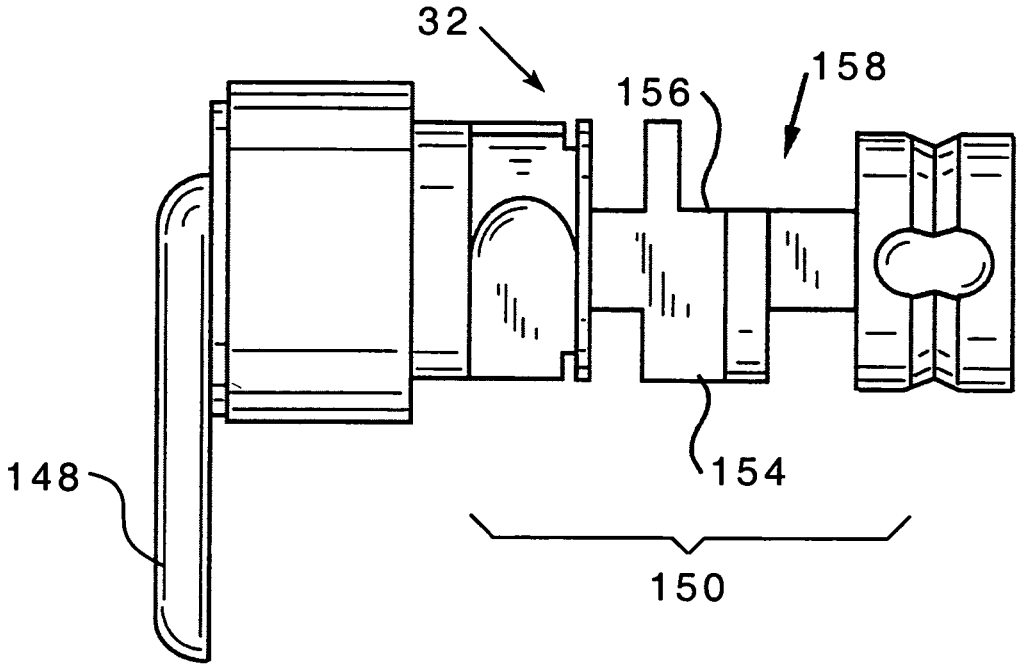
FIG. 8 is a side view of a four position selector switch for a firearms training simulator according to the present invention.
Figure 9:
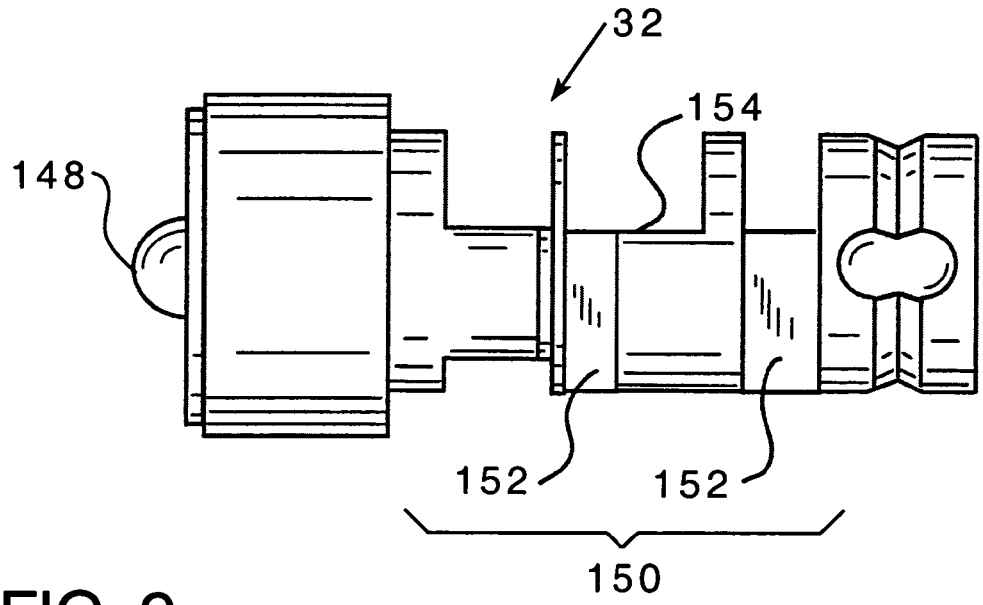
FIG. 9 is a side view of a four position selector switch for a firearms training simulator according to the present invention, rotated 90° from the position of FIG. 8.
Figure 10:
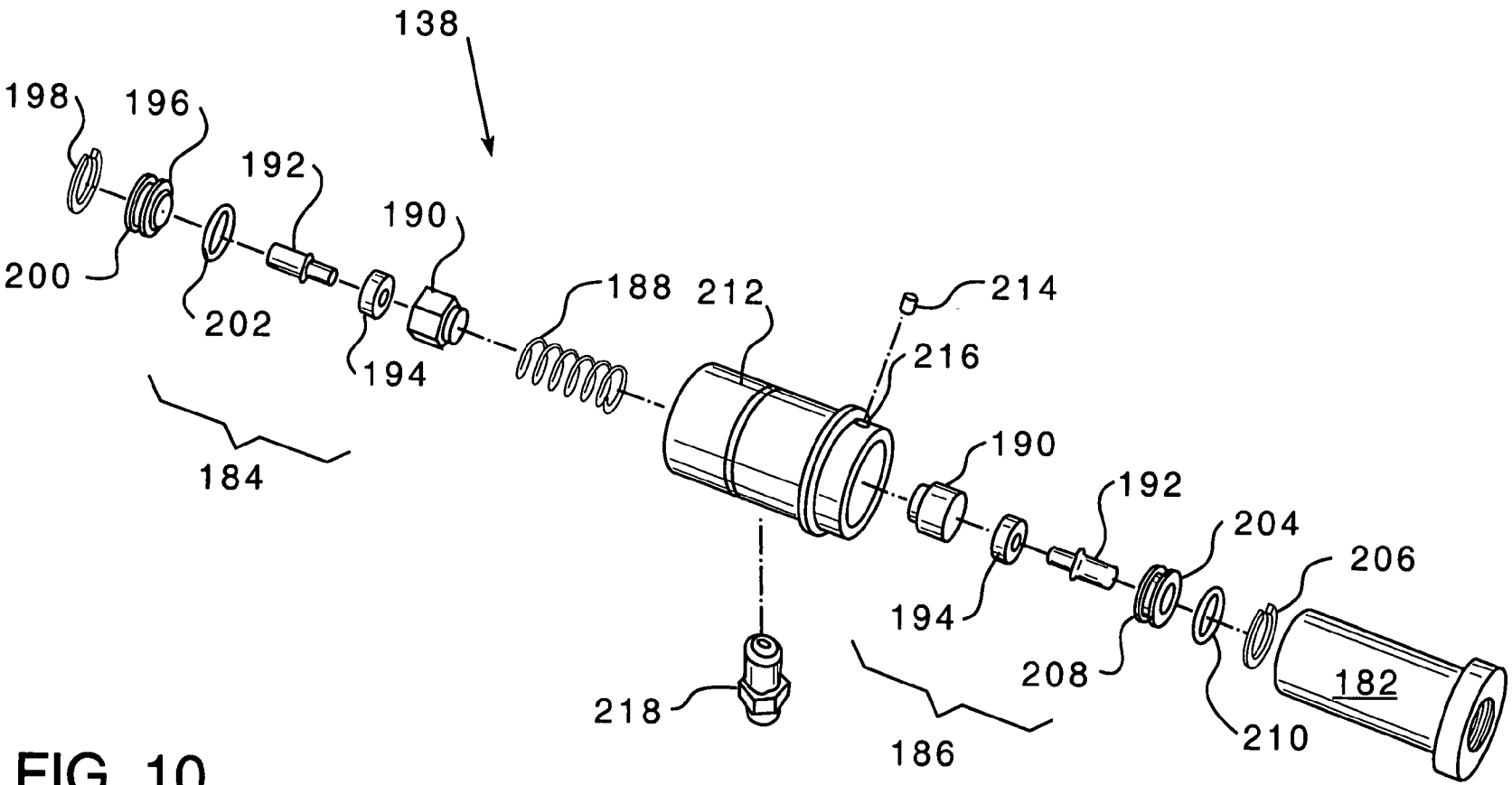
FIG. 10 is an exploded side isometric view of a valve assembly for a firearms training simulator according to the present invention.

Referring to FIGS. 11 to 15, the trigger assembly 136, bolt 80, and valve assembly 138 are illustrated. The trigger 30 is pivotally secured within the lower receiver 14 at pivot 140, and is biased toward its forward position by the trigger return spring 142. The trigger 136 includes a finger engaging portion 144, and a selector engaging portion 146. The selector engaging portion 146 is structured to abut a selector 32 when the trigger 30 is pulled rearward. The selector 32 is best illustrated in FIGS. 8-9. The selector 32 includes an actuator 148 for permitting the shooter to rotate the selector 32 as explained below, and a trigger engaging portion 150. The trigger engaging portion 150 includes a first surface 152, corresponding to safe. A second surface 154 of the trigger engaging portion 54 corresponds to semi-automatic fire. A third surface 156 of the trigger engaging portion 54 corresponds to full automatic fire at a slow cyclic rate. This surface 156 is different from selectors used in firearms in that it is cut to a different geometry to be used as a cam stop for the trigger as opposed to a surface that controls disconnectors. It is therefore sufficiently different that it cannot be used in a firearm. Lastly, the trigger engaging portion 54 defines a channel 158 corresponding to full automatic fire at a high cyclic rate. Referring back to FIGS. 11 to 15, the trigger 30 is pivotally secured to one end of a trigger bar 160, with the other end of the trigger bar 160 secured to a sear trip 162. The sear trip 162 includes a sear engaging end 164, having an upper radius surface 166 and a lower radius surface 168. The sear 170 is pivotally secured within the lower receiver 14 by a sliding pivot 172. The sear 170 includes a front end 174; structured to engage the sear trip 162, and a back end 176, structured to mate with a notch 178 defined within the bolt 80. A spring 180 biases the sear rearward, and the front end 174 downward.

Referring to FIGS. 10 to 15, the valve assembly 138 is illustrated. The valve assembly 138 includes a valve body 182 having a forward valve 184 and rear valve 186 therein, with the forward valve 184 and rear valve 186 being separated and biased away from each other by the spring 188. In the illustrated embodiment, the forward valve 184 and rear valve 186 each include a stop 190, with a plunger 192 extending outwardly therefrom. A seal 194 is retained on the stop 190 by the plunger 192. A forward bushing 196 is retained within the forward portion of the valve body 182 by a retaining ring 198. The forward bushing 196 defines a circumferential groove 200 for securing the O-ring 202 therein. Likewise, a rear bushing 204 is secured within the rear portion of the valve body 182 by a retaining ring 206. The rear bushing 204 defines a circumferential groove 208 for securing an O-ring 210 therein. A preferred valve assembly 138 is a captive assembly, which in the illustrated embodiment includes a housing 212 fitting over the body 182, with the body 182 secured within the housing 212 by a pin 214 fitting within the hole 216 defined within the housing 212. The valve assembly 138 is therefore secured together by the interaction of the retaining ring 206 and the valve body 182 at its back end, and by the interaction of the retaining ring 198 and the housing 212 at its forward end. A compressed gas inlet fitting 218 is secured within the housing 212, and is in communication with a source of compressed gas.

In use, the front rear valve 184 will be stationary. The unit formed by the housing 212 and body 182 reciprocates between a forward position and a rearward position, with the seal 194 of the forward valve 184 bearing against the bushing 196 to close the front valve 184 when the body 182/housing 212 are in their rearward position, and with the seal 194 being separated from the bushing 196 when the housing 212 and body 182 are in their forward position. The rear valve 186 reciprocates within the body 182. In the rearward position of the valve 186, the seal 194 is pressed against the bushing 204, closing the rear valve 186. When the rear valve 186 moves forward, the seal 194 is separated from the bushing 204, thereby opening the rear valve.

Figure 17:
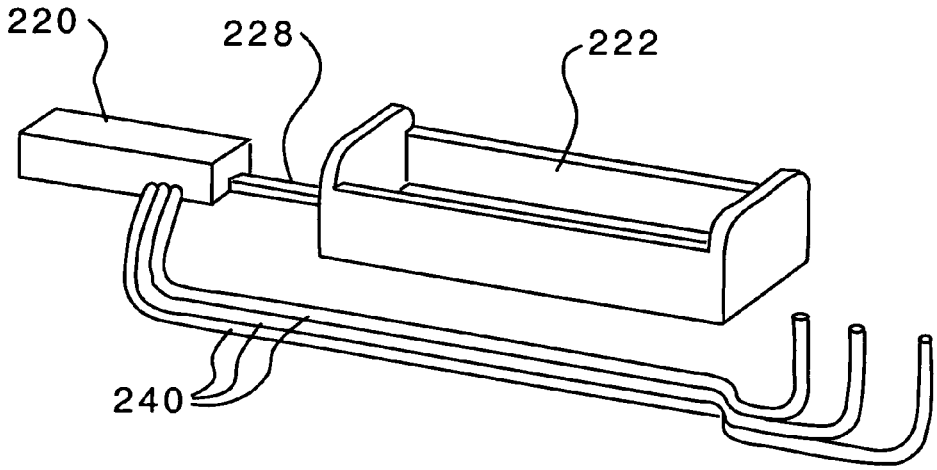
FIG. 17 (Prior Art)
FIG. 17 is a side isometric view of the electronic components of a laser simulator for a firearms training simulator.
Figure 18:
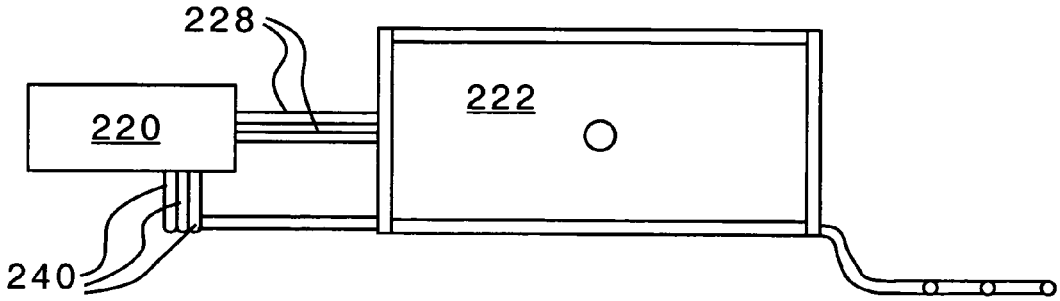
FIG. 18 (Prior Art)
FIG. 18 is a top view of the electronic components for a laser simulator for a firearms training simulator.
Figure 19:
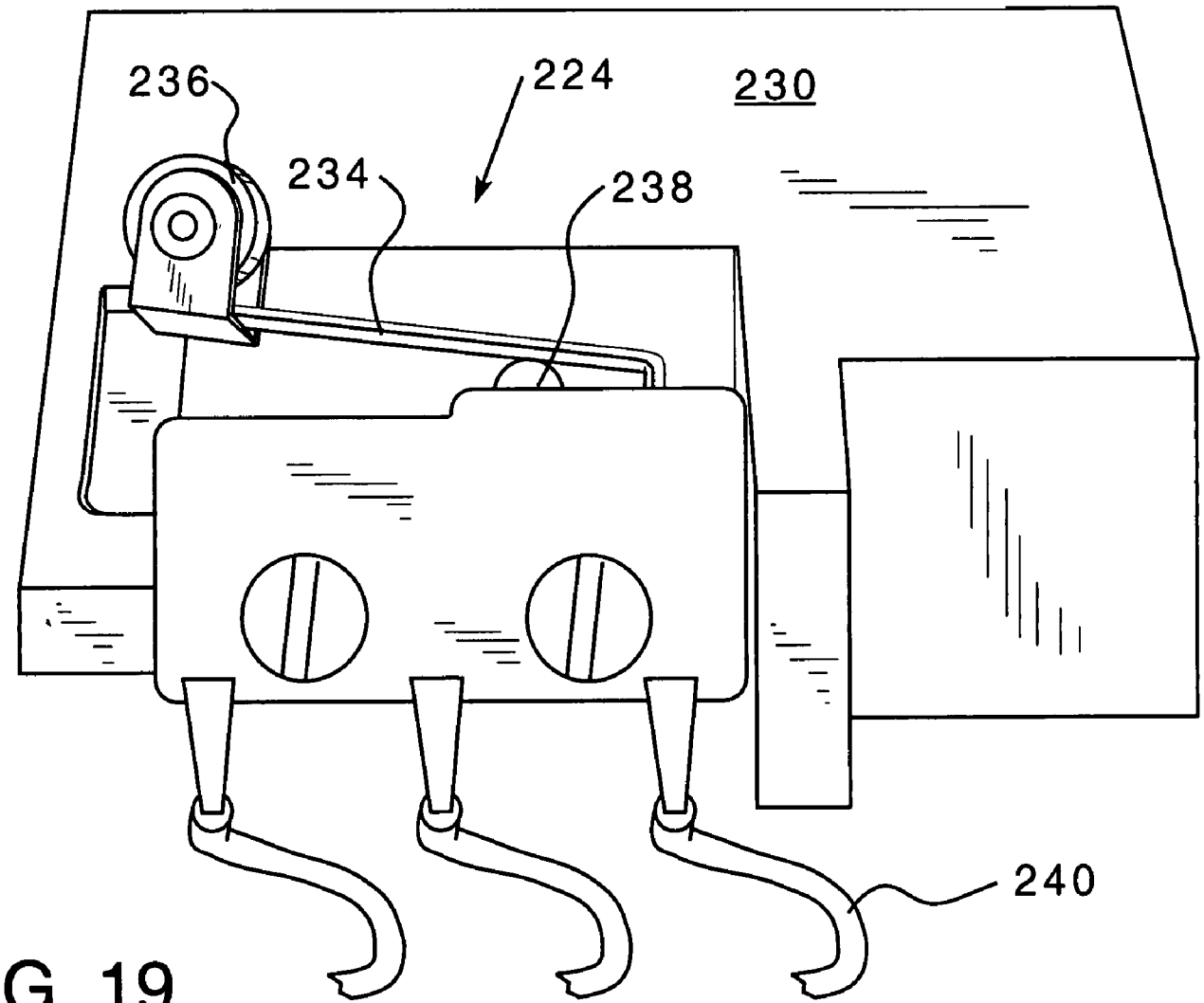
FIG. 19 is a side view of a roller switch for a laser simulator for a firearms training simulator according to the present invention.
Figure 25:
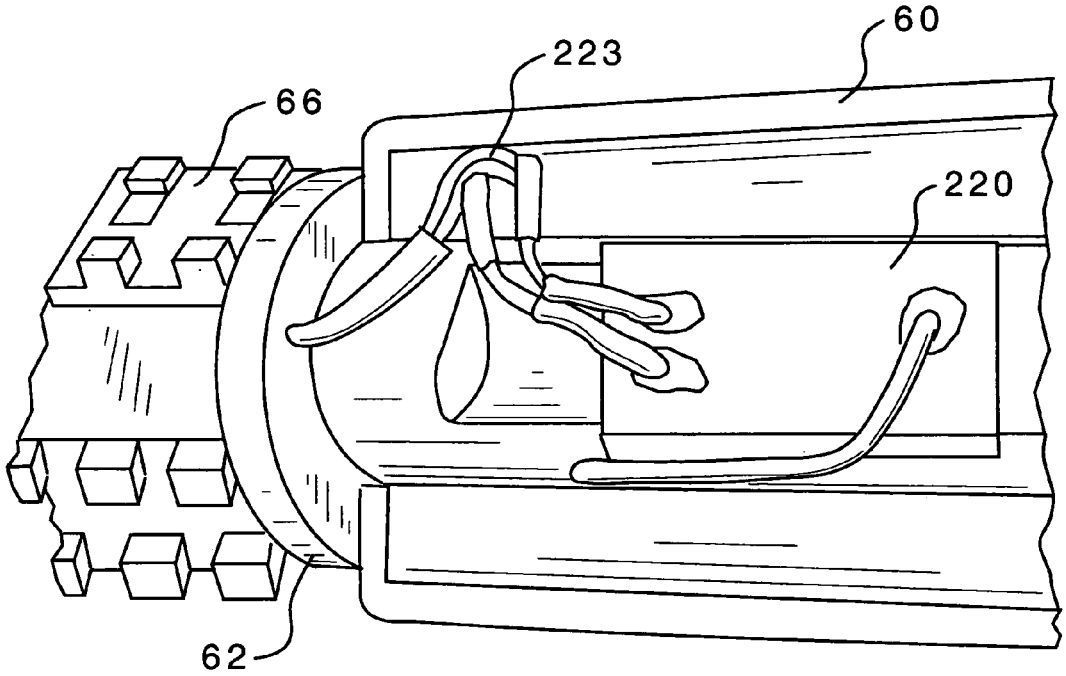
FIG. 25 is a top view of the electronics for a laser emitter for a firearms training simulator according to the present invention.
Figure 26:
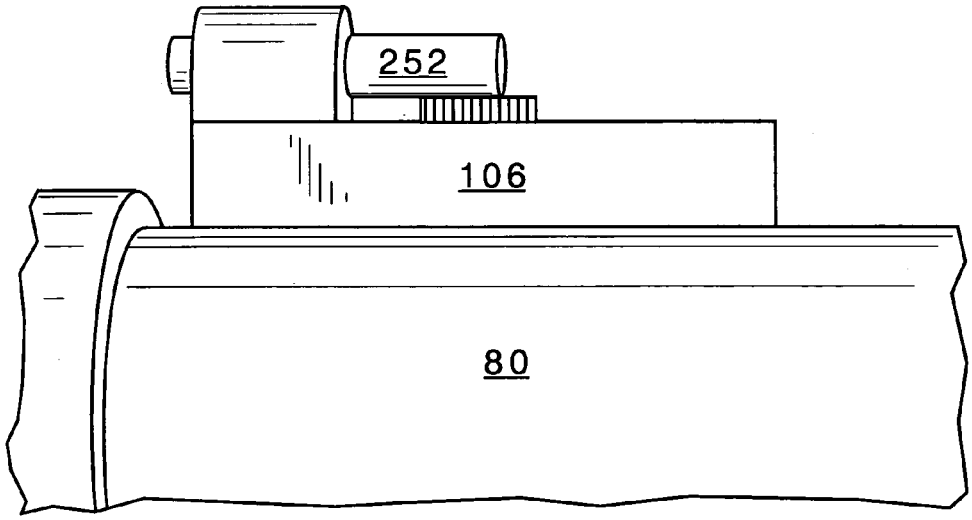
FIG. 26 is a side view of a magnet for use with a proximity switch within a firearms training simulator of the present invention.

Referring to FIG. 16, the barrel assembly 54 is illustrated in greater detail. The various components of the laser emitter assembly are located within the barrel assembly 54. Many components of a preferred laser emitter assembly are available from Laser Shot, located in Stafford, Tex. Referring to FIGS. 16 to 18, the laser emitter assembly includes a circuit board 220, a battery box 222, a switch 224, and a laser emitter 226. The laser emitter 226 is preferably housed within the front sight block 66, and is oriented to emit a laser beam substantially parallel to the barrel 56. The remaining components are housed between the upper handguard 58 and lower handguard 60, where they are well protected and easily serviced by retracting the lock ring 64, and removing the handguards 58, 60. The circuit board 220 and battery box 222 are mounted directly to the barrel 56. A pair of wires 228 supply the circuit board 220 with electrical power from the batteries contained within the battery box 222. A pair of wires 223 (FIG. 25) carries electrical power from the circuit board 220 to the laser emitter 226. A switch 224 is also mounted to the barrel 56, in the illustrated embodiment by being secured to a front clamp 230, which is itself secured to the barrel 56. The switch 224 is best illustrated in FIG. 19. The illustrated embodiment of the switch 224 is a roller switch, having a body 232 with a switch on 234 extending therefrom. A roller 236 is rotatably mounted at the end of the switch on 234. A button 238 protrudes from the switch body 232, abutting the switch on 234, so that depressing the switch on 234 also depresses the button 238. The body 232 of the switch 224 is electrically connected to the circuit board 220 by the wires 240.

Figure 20:
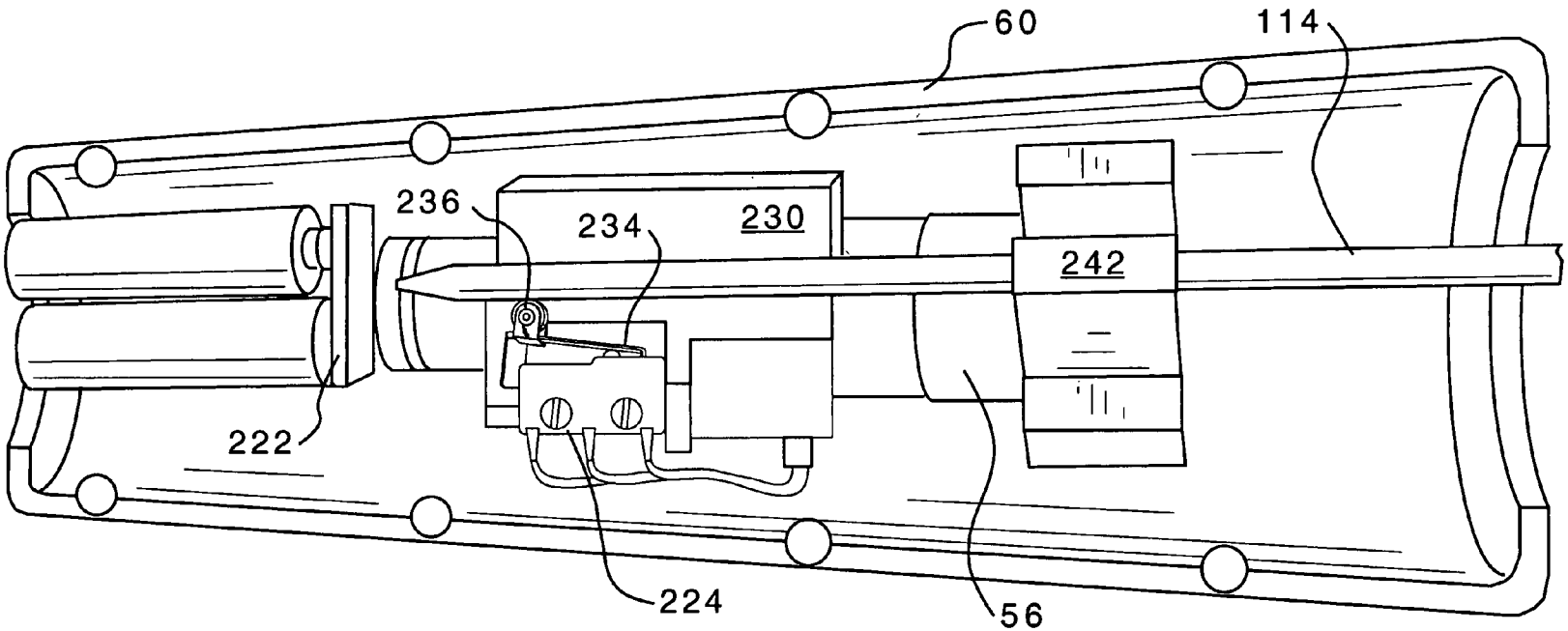
FIG. 20 is a top view of a barrel assembly, the electronics for a laser simulator assembly, and a switch activation rod for a firearms training simulator according to the present invention.
Figure 21:
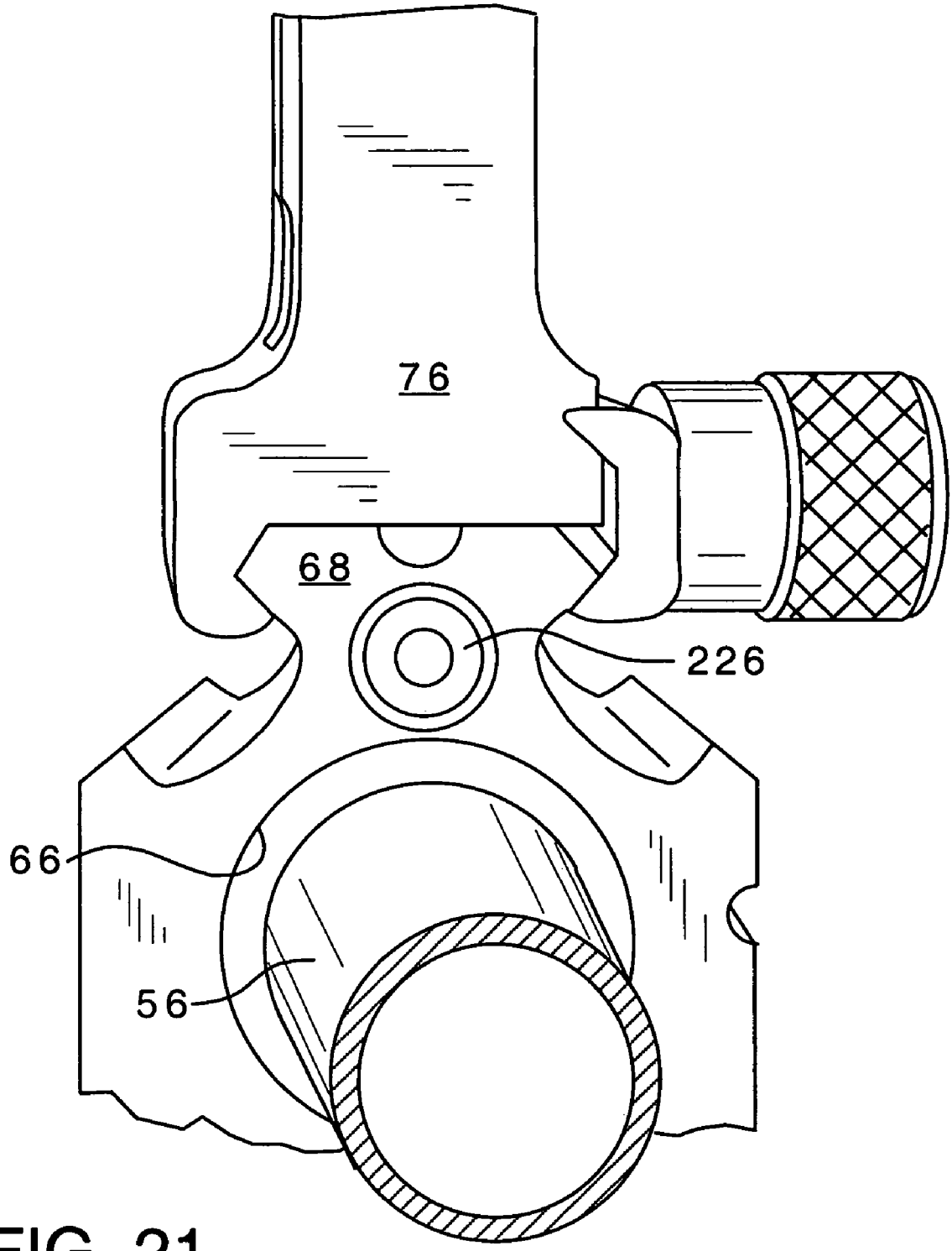
FIG. 21 is a front view of a laser emitter for a firearms training simulator according to the present invention.
Figure 22:
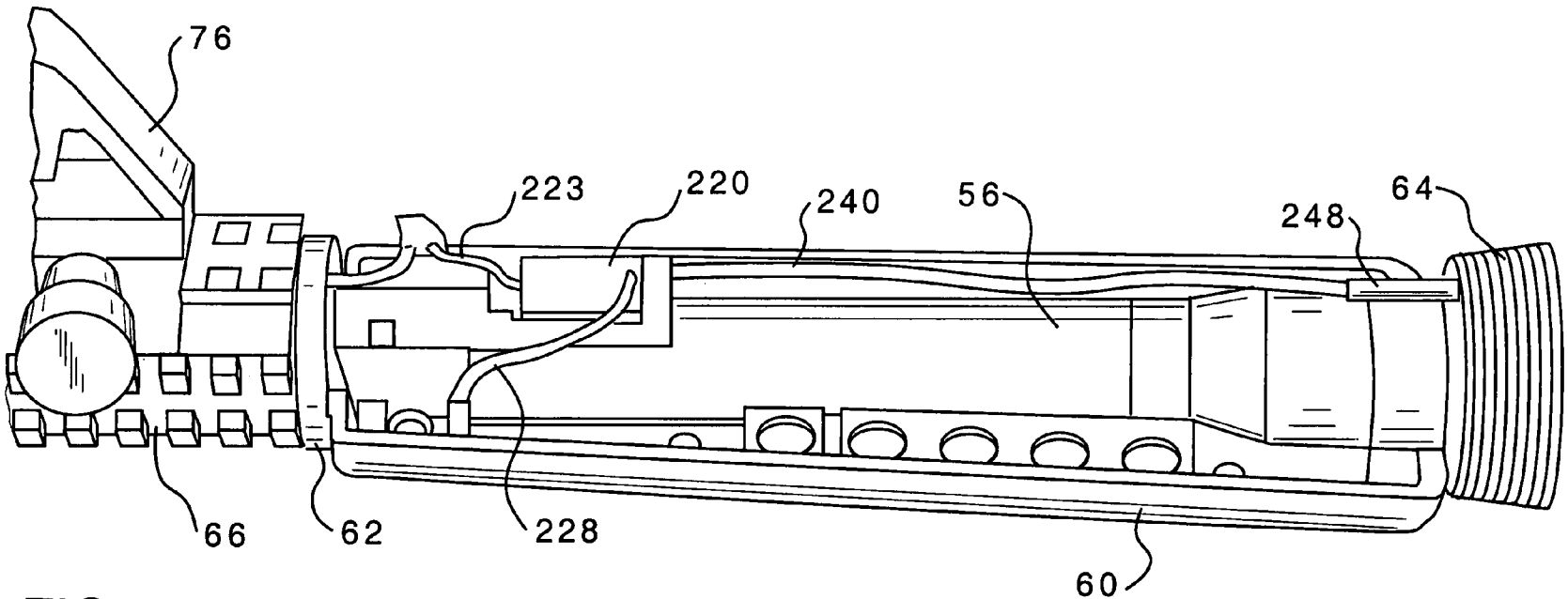
FIG. 22 is an isometric top view of a barrel assembly, and laser emitter electronics for a firearms training simulator of the present invention.
Figure 23:
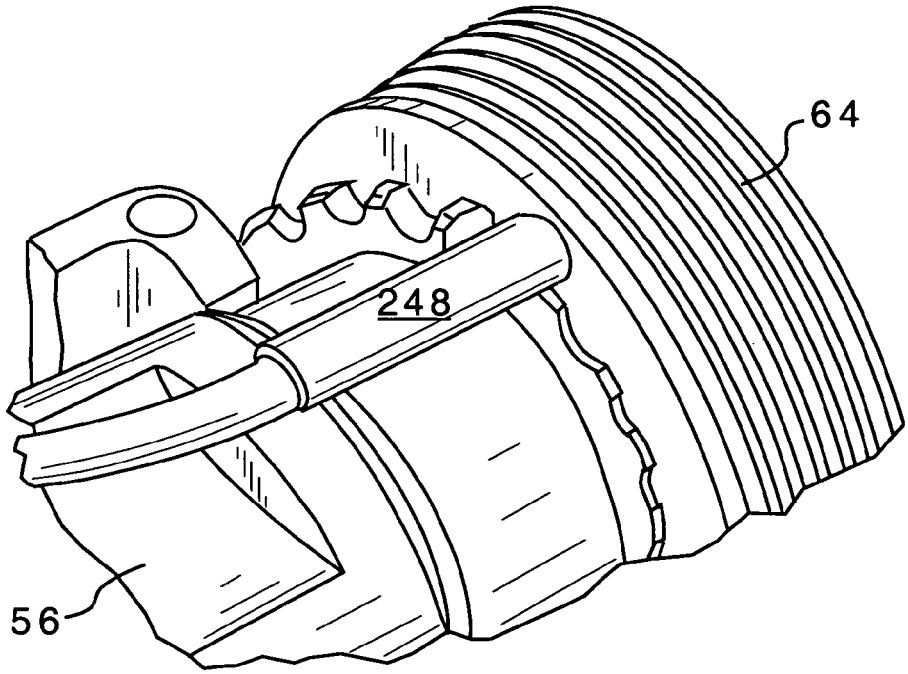
FIG. 23 is a top view of a proximity switch for a firearms training simulator of the present invention.
Figure 24:
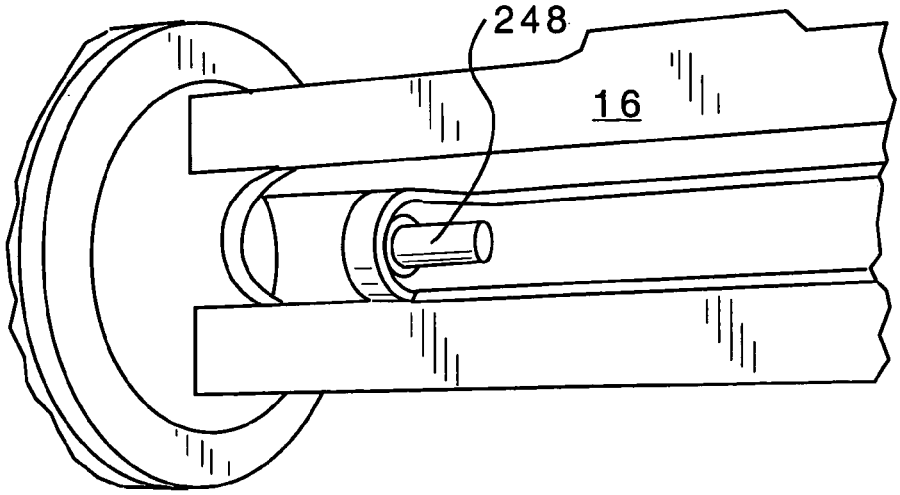
FIG. 24 is a bottom view of a proximity switch for a firearms training simulator according to the present invention.

The barrel assembly 54 also includes a rear clamp 242, having a barrel aperture 244 for securing the clamp 242 around the barrel 56, and a switch activation rod guide aperture 246 structured to receive and guide the switch activation rod 114 as it reciprocates with the bolt, so that the switch activation rod 114 will engage the roller 236 and depress the switch on 234 when the bolt 80 is in its forward position, as illustrated in FIG. 20. The circuit board 220 is structured to transmit a momentary electrical current to the laser emitter 226, thereby causing the laser emitter 226 to emit a laser beam of brief duration, in a manner that is well known to those skilled in the art.

An alternative switching mechanism is illustrated in FIGS. 22 to 26. The remainder of the laser emitter assembly within these figures uses the same circuit board 220, battery box 222, and laser emitter 226 as the previously described embodiments. However, the roller switch 224 has been replaced with a proximity switch 248 mounted adjacent to the breach end 250 of the barrel 56, and passing through the lock ring 64 into the upper receiver 16. The bolt key 106 has a magnet 252 secured within the aperture 118, where it replaces the switch activation rod 114. When the bolt 80 is in its forward position, the magnet 252 is brought sufficiently close to the proximity switch 248 to trip the proximity switch 248.

To use the firearms training simulator 10, a supply of compressed gas is connected to the fitting 34. The gas selected may either be compressed air, or any compressed gas commonly used for air guns, for example, carbon dioxide. Compressed air will be supplied to the fitting tube 218 of the valve assembly 138, between the forward valve 184 and rear valve 186. Before firing, the trigger mechanism 136, valve assembly 138, and bolt 80 are in the positions illustrated in FIG. 11. The bolt 80, although biased forward by pressure from the spring 130, is held in its rear position by the rear end 176 of the sear 170 engaging the notch 178. Pressure from the spring 180 holds the sear 170 in this position. Forward pressure from the bolt 80 against the sear 70 pushes the sear towards its forwardmost position on the sliding pivot 172. The trigger spring 142 holds the trigger 30 in its forwardmost position. The selector 32 may be rotated to the appropriate position, corresponding to safe, semi-automatic, or full automatic at a low or high cyclic rate.

Figure 12:
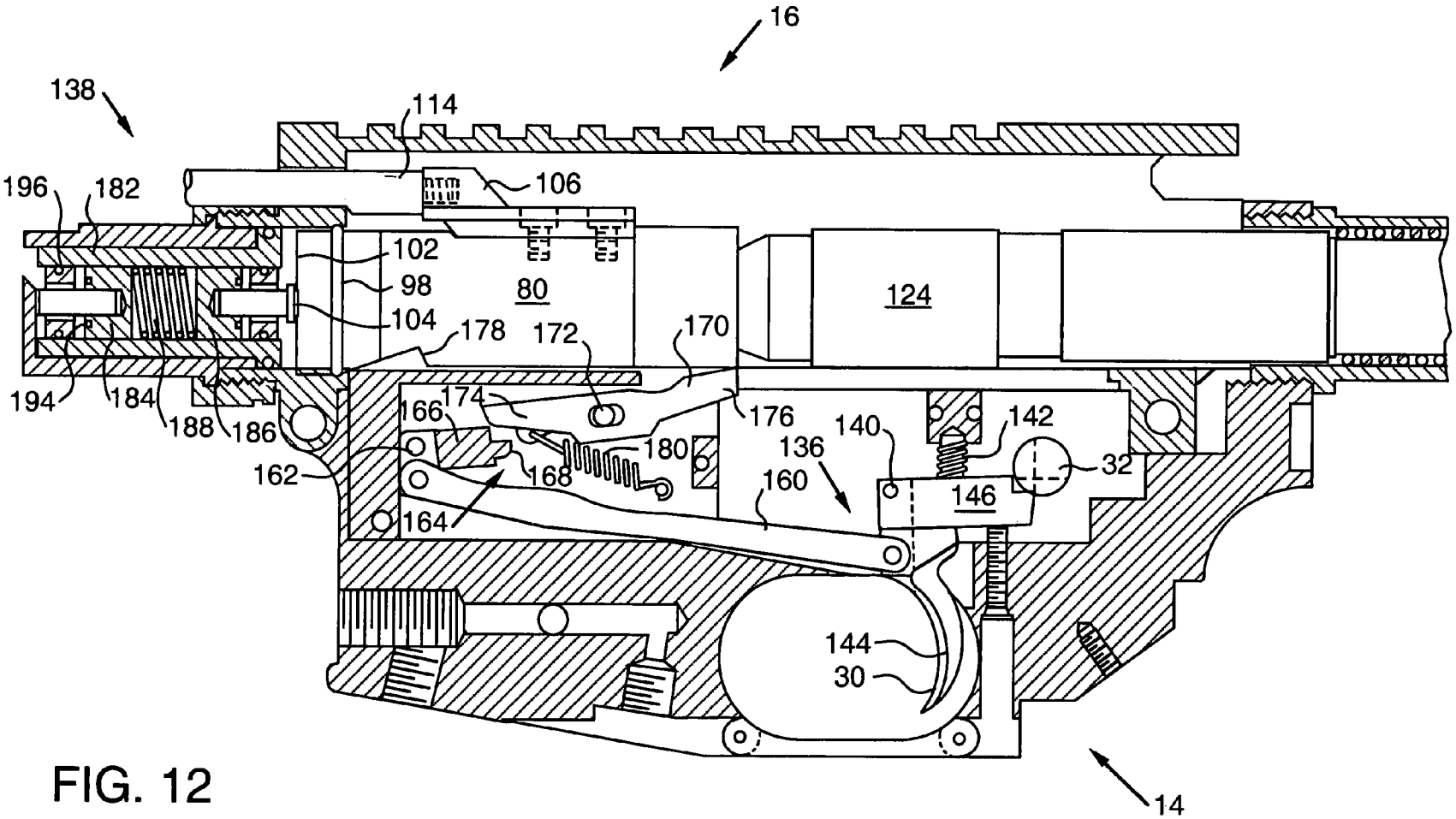
FIG. 12 is a side cross-sectional view of a trigger assembly, valve assembly, and bolt of a firearms training simulator according to the present invention, showing the position of the components at the moment of firing.

FIG. 12 depicts the location of the parts when the trigger is pulled. Trigger 30 has been pulled rearward until the selector engaging portion 146 engages the surface 154, 156, or channel 158 of the selector 32. The trigger bar 160 has moved rearward, thereby pivoting the end 164 of the sear trip 162 upward so that the radiused surface 166 pushes the sear's forward end 174 upward, thereby pivoting the sear's back end 176 downward, releasing the bolt 80 to travel forward. When the bolt 80 reaches its forwardmost position, air pressure between the bolt 80 and valve body 182 causes the valve body 182 to move forward, thereby opening the forward valve 184. At the same time, the bolt 80 strikes the plunger 192 of the rear valve 186, thereby moving the rear valve 186 forward to open the rear valve 186, thereby releasing compressed air to the bolt 80. At the same time, depending upon the embodiment selected, either the switch activation rod 114 has engaged and depressed the roller 236 of the switch on 234, thereby tripping the switch 224, or alternatively the magnet 252 has been brought into proximity with the proximity switch 248, thereby triggering the circuit board 220 to signal the laser emitter 226 to emit a laser. The bolt 80 is then pushed to its rearward position by the compressed air released from the rear valve 186, as the pressure from the compressed air overcomes the bias of the spring 130.

Figure 13:
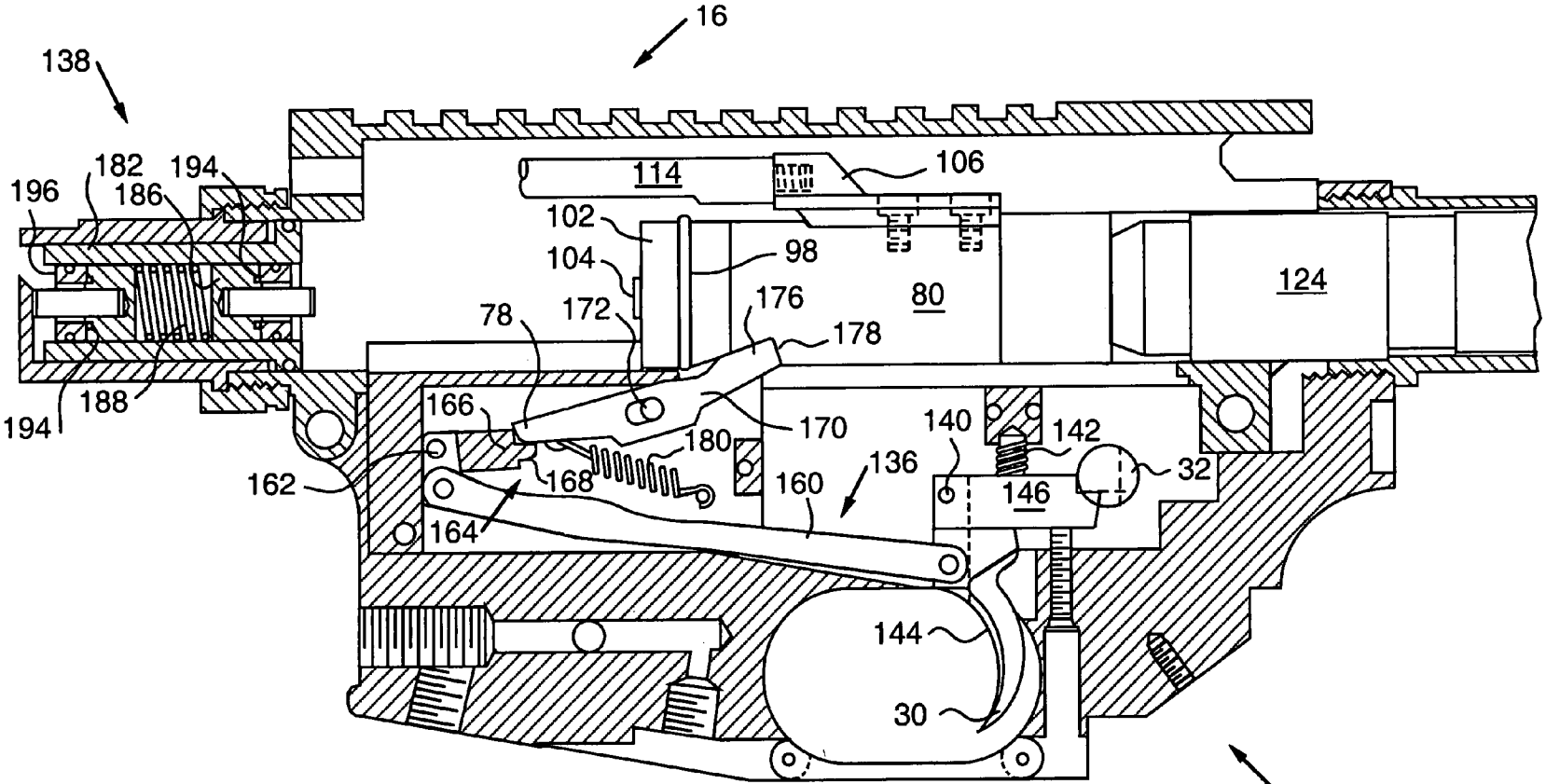
FIG. 13 is a side cross-sectional view of a trigger assembly, valve assembly, and bolt of a firearms training simulator according to the present invention, showing the position of the parts after firing with the trigger still depressed during semi-automatic fire.

FIG. 13 depicts the location of the components after firing a shot in semi-automatic mode, with the trigger still depressed. The spring 180 has pulled the sear 170 to the rear, where the end 174 slips off the radiused surface 166, permitting the sear to rotate so that the rear end 176 rotates upward. The bolt 80 is retracted to a position slightly behind the point where the notch 178 engages the sear 170. As the bolt 80 returns forward under pressure from the spring 130, the notch 178 and sear 176 engage each other, thereby arresting forward travel of the bolt 80. At this point, releasing the trigger 30 is necessary to fire another shot.

Figure 14:
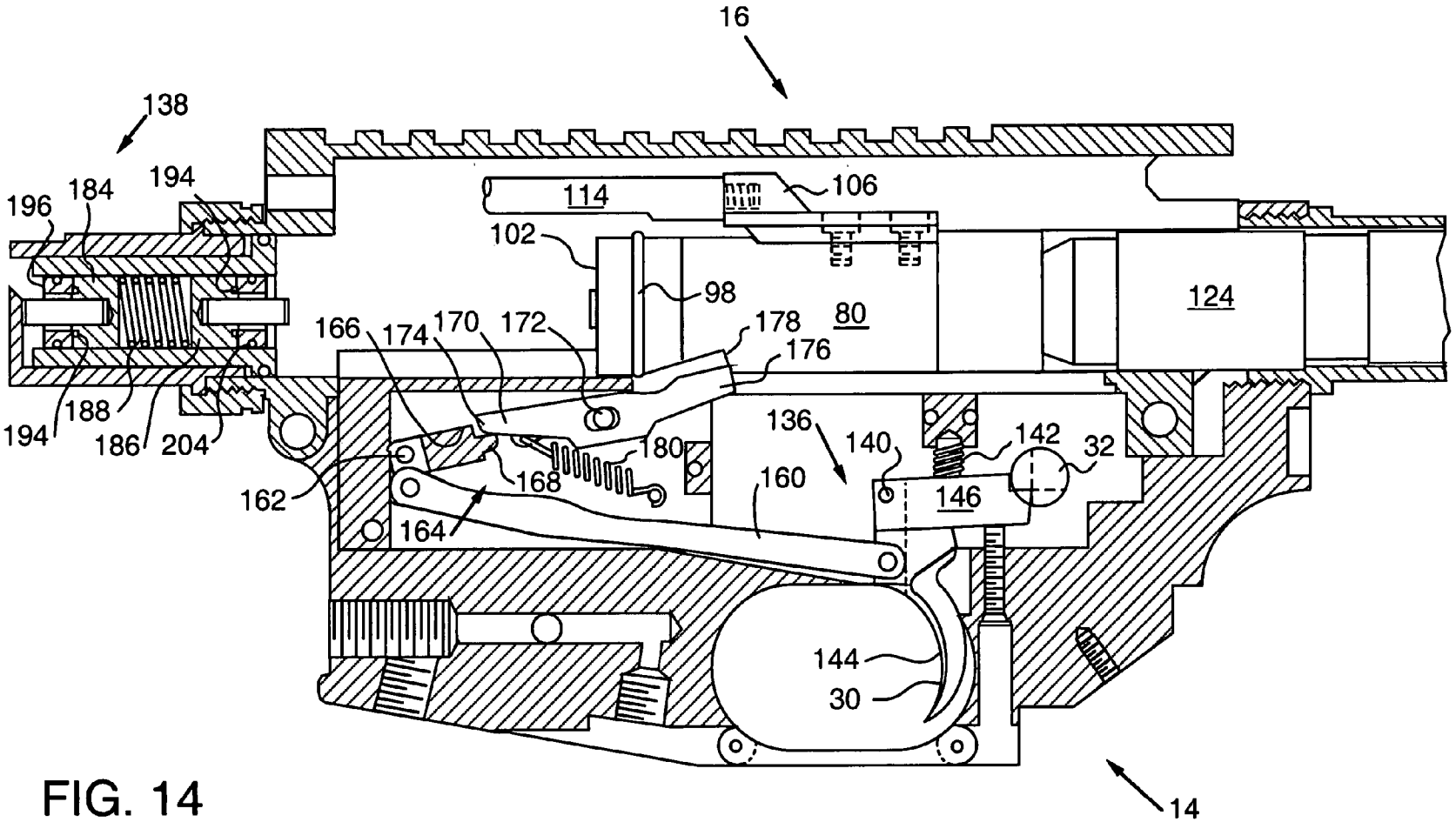
FIG. 14 is a side cross-sectional view of a trigger assembly, valve assembly, and bolt of a firearms training simulator according to the present invention, showing the position of the components after the bolt has returned and with the trigger still pulled during full automatic fire at a slow cyclic rate.

FIG. 14 depicts the position of the parts when the firearms training stimulator 10 is discharged in full automatic mode at a slow rate of fire. In this mode of operation, the selector 32 is rotated so that the surface 156 engages the selector engaging portion 146 of the trigger 30. The trigger 30 is thereby permitted to move back farther than in semi-automatic mode, wherein the surface 154 was engaged. As before, gas pressure forces the bolt 80 back to a position slightly behind the point wherein it engages the sear 170. The sear trip 162 is thereby rotated slightly higher, so that the lower radius 168 pushes upward on the front end 174 of the sear 170. The sear 170 is pulled towards its rearmost position on the sliding pivot 172 by the spring 180, and is thereby also pulled so that the rear end 176 of the sear 170 is rotated upward. As the bolt 80 returns forward under pressure from spring 130, about 1/32 inch of the rear end 176 of the sear 170 catches the notch 178 of the bolt 80. The floating mass 86, which at this point will be located in the rear portion of the bolt 80, has slowed the bolt 80 sufficiently so that it will momentarily catch on the sear 170. When the bolt 80 engages the sear 170, forward pressure applied to the sear 170 by the bolt 80 will cause the sear 170 to cam off the radiused surface 166 as it moves towards its forwardmost position on a sliding pivot 172, rotating the sear 170 out of the path of the bolt 80. The bolt 80 is then free to travel forward to discharge another shot.

Figure 15:
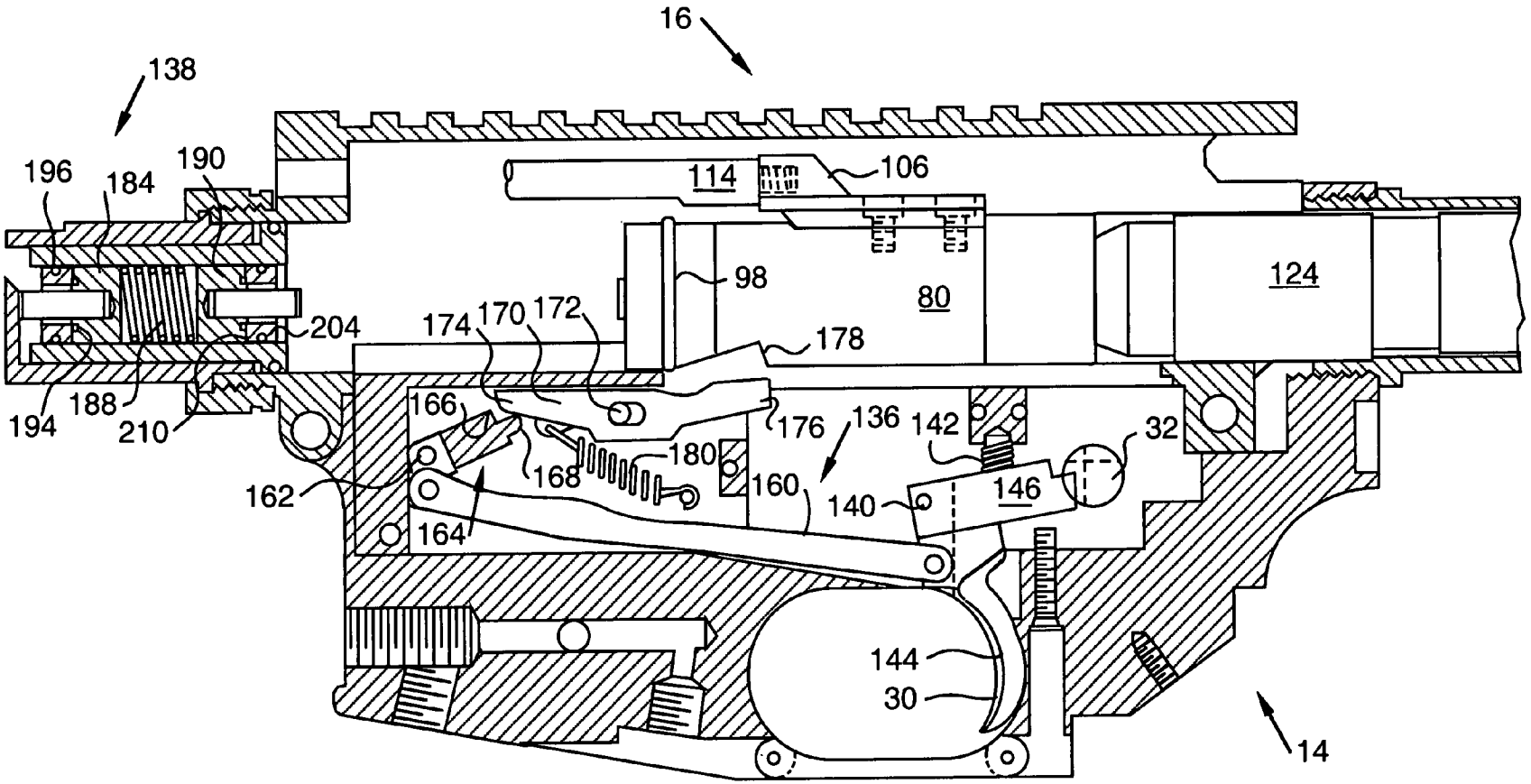
FIG. 15 is a side cross-sectional view of a trigger assembly, valve assembly, and bolt of a firearms training simulator according to the present invention, showing the position of the components with the bolt retracted and trigger depressed during full automatic fire at a high cyclic rate.

FIG. 15 depicts the location of the parts if full automatic fire at a high cyclic rate is selected. The selector 32 is rotated so that the selector engaging portion 146 of the trigger 30 corresponds to the channel 158 within the selector 32, permitting the trigger 30 to travel to its maximum rearward position. The sear trip 162 is thereby rotated to its maximum upward position, thereby rotating the sear 170 completely out of the way of the bolt 80. When the bolt 80 travels rearward sufficiently for the spring 130 to overcome the air pressure from the valve 186, there is nothing to impede the forward motion of the bolt 80. This results in a maximum cyclic rate.

A typical cyclic rate for full automatic fire with a low cyclic rate is approximately 600 rounds per minute. A typical cyclic rate for full automatic fire at a high cyclic rate is approximately 900 rounds per minute, approximately simulating the cyclic rate of an M-16 rifle.

If desired, the lower receiver assembly 14 and components therein of the firearm training simulator 10 of the present invention may be mated with an upper receiver assembly and barrel assembly of an air gun as disclosed in U.S. patent application Ser. No. 09/756,891, from which this application is a continuation-in-part. The trainee therefore has the option of training using either a laser simulator or an air gun merely by mounting the appropriate upper receiver and barrel assembly on the same lower receiver assembly. The upper and lower receiver assemblies 14, 16, may be detached from one another by first driving the takedown pin 24 to its rightmost position, and then removing the screw or pin 18. Those skilled in the art will recognize that this is the same method of removing the upper assembly from the lower assembly of a conventional M-16 or AR-15 rifle.

The firearms training simulator therefore simulates the recoil, cyclic rate, configuration, controls, and mode of operation of the firearm for which it is intended to be used to train a shooter. The training simulator therefore provides the opportunity to conduct decision-making training scenarios projected on a screen, with the safety and reduced facilities cost of using a laser instead of live ammunition, while duplicating a sufficient number of the characteristics of a conventional firearm so that the training will effectively carry over to a conventional firearm.

While a specific embodiment of the invention has been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalence thereof.

What is claimed is:

1. A firearms training simulator, comprising:

a means for simulating a recoil comprising:

a bolt reciprocating between a forward position and a rearward position, said bolt being biased towards its forward position, said bolt having a gas-receiving surface;

a trigger assembly structured to resist forward motion of the bolt, and to permit forward movement of the bolt upon actuation of a trigger;

a valve assembly structured for communication with a supply of compressed gas, the valve assembly being dimensioned and configured to discharge compressed gas rearward onto said bolt face when said bolt reaches its forward position;

a laser emitter assembly structured to emit a laser upon actuation of the trigger, in a direction substantially parallel to a barrel of the firearms training simulator; whereby the firearms training simulator simulates a recoil that is enhanced to substantially the same level of recoil that is generated by a gun firing a powder-propelled projectile;

wherein an activation device is operatively coupled to the bolt, and wherein the activation device is structured to actuate the laser emitter assembly upon the forward movement of the bolt.

2. The firearms training simulator according to claim 1, wherein said valve assembly comprises:

a stationary forward valve;

a housing reciprocating between a forward position wherein said forward valve is open, and a rearward position wherein said forward valve is closed, said housing being biased towards its rearward position; and a rear valve reciprocating between a forward position wherein said rear valve is open, and a rearward position wherein said rear valve is closed, said rear valve being biased towards its rearward position.

3. The firearms training simulator according to claim 2, further comprising a spring dimensioned and configured to bias said housing and said rear valve towards their rear positions.

4. The firearms training simulator according to claim 3, wherein said spring, forward valve, and rear valve form a captive assembly.

5. The firearms training simulator according to claim 1, wherein said bolt includes a floating mass.

6. The firearms training simulator according to claim 5, wherein said floating mass is a piston.

7. The firearms training simulator according to claim 6, wherein said piston is spring-biased towards a forward position within said bolt.

8. The firearms training simulator according to claim 1, further comprising a buffer assembly dimensioned and configured to bias said bolt towards its forward position, and to provide a recoil for a shooter.

9. The firearms training simulator according to claim 8, wherein said buffer assembly comprises a spring-biased air resistance bolt driver.

10. The firearms training simulator according to claim 9, wherein said air resistance bolt driver comprises two detachable components, dimensioned and configured for use within buffer tubes having at least two different lengths.

11. The firearms training simulator according to claim 8, wherein said buffer assembly comprises a spring-biased floating mass bolt driver.

12. The firearms training simulator according to claim 8, wherein said buffer assembly comprises:

an air resistance bolt driver;

a floating mass bolt driver; and a spring disposed there between.

13. The firearms training simulator according to claim 1, wherein the trigger assembly comprises:

a trigger having a finger-engaging portion and a selector-engaging portion;

a selector, comprising:

a first surface dimensioned and configured to abut said selector-engaging portion of said trigger and to resist movement of said trigger;

a second surface dimensioned and configured to abut said selector-engaging portion of said trigger and to permit a first distance of movement of said trigger;

a third surface dimensioned and configured to abut said selector-engaging portion of said trigger and to permit a second distance of movement of said trigger, said second distance of movement being greater than said first distance of movement;

a channel dimensioned and configured to permit a third distance of movement of said trigger, said third distance of movement being greater than said second distance of movement; and said selector is dimensioned and configured to permit said first surface, second surface, third surface, and channel to be selectively positioned to engage said trigger's selector-engaging portion.

14. The firearms training simulator according to claim 13, wherein said first surface corresponds to safe, said second surface corresponds to semiautomatic operation, said third surface corresponds to full automatic operation at a first cyclic rate, and said channel corresponds to full automatic operation at a second cyclic rate, said second cyclic rate being faster than said first cyclic rate.

15. The firearms training simulator according to claim 13, further comprising a sear trip operatively associated with said trigger.

16. The firearms training simulator according to claim 15, further comprising a sear, said sear having a first end dimensioned and configured to selectively engage and release a bolt, and a second end dimensioned and configured to engage said sear trip, said sear being spring-biased into engagement with said bolt, said sear being secured to a receiver by a sliding pivot.

17. The firearms training simulator according to claim 16, wherein said sear trip further comprises an end having an upper step and a lower step, with said upper step and lower step each having a radiused corner.

18. The firearms training simulator according to claim 1, wherein electronics and batteries for the laser emitter assembly are secured to the barrel, covered by a removable handguard assembly.

19. The firearms training simulator according to claim 1, further comprising became a laser emitter disposed within a front sight block.

20. A firearms training simulator comprising:

a means for simulating a recoil comprising:

a bolt reciprocating between a forward position and a rearward position, said bolt being biased towards its forward position, said bolt having a gas-receiving surface;

a trigger assembly structured to resist forward motion of the bolt, and to permit forward movement of the bolt upon actuation of a trigger;

a valve assembly structured for communication with a supply of compressed gas, the valve assembly being dimensioned and configured to discharge compressed gas rearward onto said bolt face when said bolt reaches its forward position; and a laser emitter assembly structured to emit a laser upon actuation of the trigger and upon the forward movement of the bolt, in a direction substantially parallel to a barrel of the firearms training simulator, the laser emitter assembly comprising:

a switch disposed on the barrel; and a switch activation rod extending forward from the bolt, the switch activation rod being structured to actuate the switch upon the forward movement of the bolt;

whereby the firearms training simulator simulates a recoil that is enhanced to substantially the same level of recoil that is generated by a gun firing a powder-propelled projectile.

21. The firearms training simulator according to claim 20, wherein the switch is a roller switch having a switch arm pivotally secured at one end and a roller at a free end, the roller being structured to engage the switch activation rod as the switch activation rod passes over the switch, thereby depressing the switch arm and actuating the switch.

22. A firearms training simulator comprising:

a means for simulating a recoil comprising:

a bolt reciprocating between a forward position and a rearward position, said bolt being biased towards its forward position, said bolt having a gas-receiving surface;

a trigger assembly structured to resist forward motion of the bolt, and to permit forward movement of the bolt upon actuation of a trigger;

a valve assembly structured for communication with a supply of compressed gas, the valve assembly being dimensioned and configured to discharge compressed gas rearward onto said bolt face when said bolt reaches its forward position; and a laser emitter assembly structured to emit a laser upon actuation of the trigger and upon the forward movement of the bolt, in a direction substantially parallel to a barrel of the firearms training simulator, the laser emitter assembly comprising a pair of proximity switch components, one of the proximity switch components being a magnet, and the other proximity switch component being a proximity switch structured for actuation upon the magnet being brought adjacent to the proximity switch, one of the proximity switch components being mounted on the bolt, and the other proximity switch component being mounted adjacent to a forwardmost position of the bolt;

whereby the firearms training simulator simulates a recoil that is enhanced to substantially the same level of recoil that is generated by a gun firing a powder-propelled projectile.

23. The firearms training simulator according to claim 22, wherein:

the magnet is secured to the bolt by a bolt key; and the proximity switch is secured adjacent a juncture between the barrel and a receiver within which the bolt reciprocates.

* * * * *